US009326065B2

(12) United States Patent
Banba et al.

(10) Patent No.: US 9,326,065 B2
(45) Date of Patent: Apr. 26, 2016

(54) SOUND PROCESSING DEVICE, AND SOUND PROCESSING METHOD

(71) Applicant: Panasonic Corporation, Osaka (JP)

(72) Inventors: Yutaka Banba, Kanagawa (JP); Takeo Kanamori, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 92 days.

(21) Appl. No.: 14/366,702

(22) PCT Filed: Oct. 24, 2012

(86) PCT No.: PCT/JP2012/006816

§ 371 (c)(1),
(2) Date: Jun. 19, 2014

(87) PCT Pub. No.: WO2013/094103

PCT Pub. Date: Jun. 27, 2013

(65) Prior Publication Data

US 2015/0124997 A1 May 7, 2015

(30) Foreign Application Priority Data

Dec. 20, 2011 (JP) ..... 2011-278242

(51) Int. Cl.

| | |
|---|---|
| ***H04R 3/10*** | (2006.01) |
| ***H04R 3/00*** | (2006.01) |
| ***H04R 1/40*** | (2006.01) |
| ***H04R 1/32*** | (2006.01) |

(52) U.S. Cl.

CPC ..... *H04R 3/005* (2013.01); *H04R 1/326* (2013.01); *H04R 1/406* (2013.01); *H04R 2201/40* (2013.01)

(58) Field of Classification Search

None

See application file for complete search history.

(56) References Cited

U.S. PATENT DOCUMENTS

| | | | | |
|---|---|---|---|---|
| 2004/0185804 | A1 | 9/2004 | Kanamori et al. | |
| 2011/0170705 | A1* | 7/2011 | Kanamori | H04R 3/005 381/92 |
| 2015/0063592 | A1* | 3/2015 | Konchitsky | H04R 1/406 381/94.1 |

FOREIGN PATENT DOCUMENTS

| | | | |
|---|---|---|---|
| JP | 2003-153372 | A | 5/2003 |
| JP | 2004-187283 | A | 7/2004 |
| JP | 2005-136628 | A | 5/2005 |

(Continued)

OTHER PUBLICATIONS

International Search Report for Application No. PCT/JP2012/006816 dated Jan. 29, 2013.

*Primary Examiner* — Andrew L Sniezek

(74) *Attorney, Agent, or Firm* — Pearne & Gordon LLP

(57) ABSTRACT

A sound processing apparatus (400) is provided with: a directivity synthesis processing unit (410) for generating a first directivity sound pick-up signal by synthesizing a first sound pick-up signal and a relatively delayed second sound pick-up signal and a second directivity sound pick-up signal by synthesizing a relatively delayed first sound pick-up signal and a second sound pick-up signal; a comparison signal calculation unit (440) for generating a non-directivity level signal indicating the level of a sum of the directivity sound pick-up signals and a directivity level signal by adding the levels of the directivity sound pick-up signals; a level comparison unit (451) for acquiring the difference between the levels of the non-directivity level signal and the directivity level signal; and a delay control unit (452) for adjusting the delay amount such that the difference between the levels becomes smaller.

10 Claims, 22 Drawing Sheets

(56) References Cited

FOREIGN PATENT DOCUMENTS

| | | | |
|---|---|---|---|
| JP | 2007-005849 | A | 1/2007 |
| JP | 2007-081455 | A | 3/2007 |
| JP | 4990981 | B2 | 8/2012 |
| WO | 20091044562 | A1 | 4/2009 |

* cited by examiner

SOUND PROCESSING DEVICE, AND SOUND PROCESSING METHOD

TECHNICAL FIELD

The present invention relates to a sound processing apparatus and a sound processing method for performing directivity synthesis processing of picked-up sound signals output from at least two sound pickup units.

BACKGROUND ART

Conventionally, there are devices that enable directional sound pickup by performing directivity synthesis processing of picked-up sound signals from a plurality of microphones. Examples of the devices that enable directional sound pickup include remote conference systems including a sound pickup device, digital video cameras and digital still cameras (DSC).

In such a device capable of directional sound pickup (hereinafter also referred to as "sound pickup device"), an apparatus section that performs directivity synthesis processing (hereinafter referred to as "sound processing apparatus") utilizes a phase difference between sound waves for the directivity synthesis processing. Thus, the sound processing apparatus requires processing for delaying a picked-up sound signal. The amount of delay used in the delay processing is set based on an inter-terminal sound distance. The inter-terminal sound distance refers to an acoustic distance between two terminals picking up sound (here, microphones; hereinafter referred also to as "sound pickup units"). More specifically, the inter-terminal sound distance refers to a difference between arrival times of sound waves from the terminals multiplied by the speed of sound when a sound source exists on a straight line axis connecting the terminals.

Use of an incorrect delay amount in delay processing may result in a failure to obtain an intended directivity pattern (hereinafter referred to as "directivity characteristic" or "polar pattern" as appropriate). Accordingly, a delay amount needs to be a proper value corresponding to an actual inter-terminal sound distance. Setting a delay amount corresponding to an actual inter-terminal sound distance enables the sound processing apparatus to, for example, at the time of sound pickup, pick up sound from a particular direction, such as a speech voice, with the ambient noise suppressed.

However, the actual inter-terminal sound distance may deviate from an actually-measured distance between the terminals (which is a mechanistic design value) because of the influence of structural objects around the terminals such as a housing in which the microphones are incorporated. In this case, the sound processing apparatus may use an improper delay amount.

Therefore, for example, the technique described in PTL 1 (hereinafter referred to as "related art") is a technique for setting a proper delay amount.

First, from picked-up sound signals from two microphones for which an inter-terminal sound distance is known among four microphones, the related art estimates a position of a sound source based on the known inter-terminal sound distance. Then, the related art estimates positions of the other microphones from picked-up sound signals from the other microphones based on the estimated position of the sound source. More specifically, the related art adjusts the estimated values of the sound source position and the respective microphone positions so as to reduce a square error between a delay amount between the two microphones for which an inter-terminal sound distance is unknown, and an actually-measured value of such delay amount. This delay amount is calculated from the position of the sound source.

For example, a sound source is disposed at a predetermined position in one direction from among directions on a straight line connecting two microphones of a sound pickup device in an anechoic room (hereinafter referred to as "axial directions"). Then, the aforementioned related art is applied to adjust estimated values of the positions of the microphones so as to minimize the square error. Consequently, a sound processing apparatus to which the related art has been applied can estimate an actual inter-terminal sound distance with good accuracy from an angle of a direction of a sound source and a delay amount in directivity synthesis processing to provide an arbitrary directivity pattern with good accuracy.

CITATION LIST

Patent Literature

PTL 1
Japanese Patent Application Laid-Open No. 2007-81455
PTL 2
International Publication No. WO 09/044562

SUMMARY OF INVENTION

Technical Problem

Here, it is assumed that: a sound processing apparatus to which the related art is applied is used for a sound pickup device in a remote conference system; and the sound pickup device is embedded in a large solid object such as a desk.

In such case, in order to obtain a correct inter-terminal sound distance, that is, in order to perform correct delay amount estimation, it is necessary to carry the solid object to an anechoic room and to perform measurement, making the measurement cumbersome and complicated.

Also, limiting a microphone mounting structure itself in order to maintain performance of a microphone array may impose constraints on, e.g., the mounting structure and/or the device design.

Furthermore, even placing a thing on or putting a hand over an area around the microphones tends to cause a change in acoustic environment, resulting in instability in directivity characteristic.

Also, in order to calculate a proper delay amount value based on, for example, PTL 1, it is necessary to estimate a direction of a sound source; in which case, malfunction occurs in an actual environment in which there are acoustic reflections and ambient noise as in a conference room if a related art such as correlation is used.

Also, the position of a sound source relative to a sound processing apparatus is not consistently fixed, and in a situation in which a sound source position changes or a plurality of sound sources exist at the same time, the ability to follow the sound source direction deteriorates, resulting in difficulty in correct delay estimation. In other words, the related art has the problem of, if an acoustic change occurs in, e.g., a structure and/or a position in which microphones are mounted and structures around the microphones, failing to perform correct delay estimation.

Accordingly, for such sound processing apparatuses, there is a demand for a technique that enables easier acquisition of required sound with high quality by providing an optional directivity pattern with good accuracy even when an acoustic change occurs. In other words, there is a demand for a technique that makes it possible to accurately adjust a delay amount in an actual environment.

An object of the present invention is to accurately adjust a delay amount in an actual environment even when an acoustic change occurs in, e.g., a structure and/or a position in which microphones are mounted and structures around the microphones.

Solution to Problem

A sound processing apparatus according to an aspect of the present invention is an apparatus that performs directivity synthesis processing of a first picked-up sound signal output from a first sound pickup unit and a second picked-up sound signal output from a second sound pickup unit, the apparatus including: a directivity synthesis processing section that generates a first directional picked-up sound signal by delaying the second picked-up sound signal relative to the first picked-up sound signal and combining the first picked-up sound signal with the delayed second picked-up sound signal, and that generates a second directional picked-up sound signal by delaying the first picked-up sound signal relative to the second picked-up sound signal and combining the delayed first picked-up sound signal with the second picked-up sound signal; a comparison signal calculation section that generates a non-directional level signal indicating a level of a signal obtained by adding up the first directional picked-up sound signal and the second directional picked-up sound signal, and that generates a directional level signal obtained by adding up a first level signal indicating a level of the first directional picked-up sound signal and a second level signal indicating a level of the second directional picked-up sound signal; a level comparison section that acquires a level difference between the non-directional level signal and the directional level signal; and a delay operation section that adjusts an amount of the delay in the directivity synthesis processing section so as to reduce the level difference.

A sound processing method according to an aspect of the present invention is a method in a sound processing apparatus that performs directivity synthesis processing of a first picked-up sound signal output from a first sound pickup unit and a second picked-up sound signal output from a second sound pickup unit, the method including: acquiring a first directional picked-up sound signal and a second directional picked-up sound signal from a directivity synthesis processing section that generates the first directional picked-up sound signal by delaying the second picked-up sound signal relative to the first picked-up sound signal and combining the first picked-up sound signal with the delayed second picked-up sound signal, and that generates the second directional picked-up sound signal by delaying the first picked-up sound signal relative to the second picked-up sound signal and combining the delayed first picked-up sound signal with the second picked-up sound signal; generating a non-directional level signal indicating a level of a signal obtained by adding up the first directional picked-up sound signal and the second directional picked-up sound signal; generating a directional level signal obtained by adding up a first level signal indicating a level of the first directional picked-up sound signal and a second level signal indicating a level of the second directional picked-up sound signal; acquiring a level difference between the non-directional level signal and the directional level signal; and adjusting the amount of delay in the directivity synthesis processing section so as to reduce the level difference.

Advantageous Effect of Invention

The present invention makes it possible to obtain an accurate inter-terminal sound distance in a real space even when an acoustic change occurs in, e.g., a structure and/or a position in which microphones are mounted and structures around the microphones.

DESCRIPTION OF EMBODIMENTS

Embodiments of the present invention will be described in detail below with reference to the accompanying drawings.

Embodiment 1

Embodiment 1 of the present invention is an example of a basic mode of the present invention.

Figure 1:
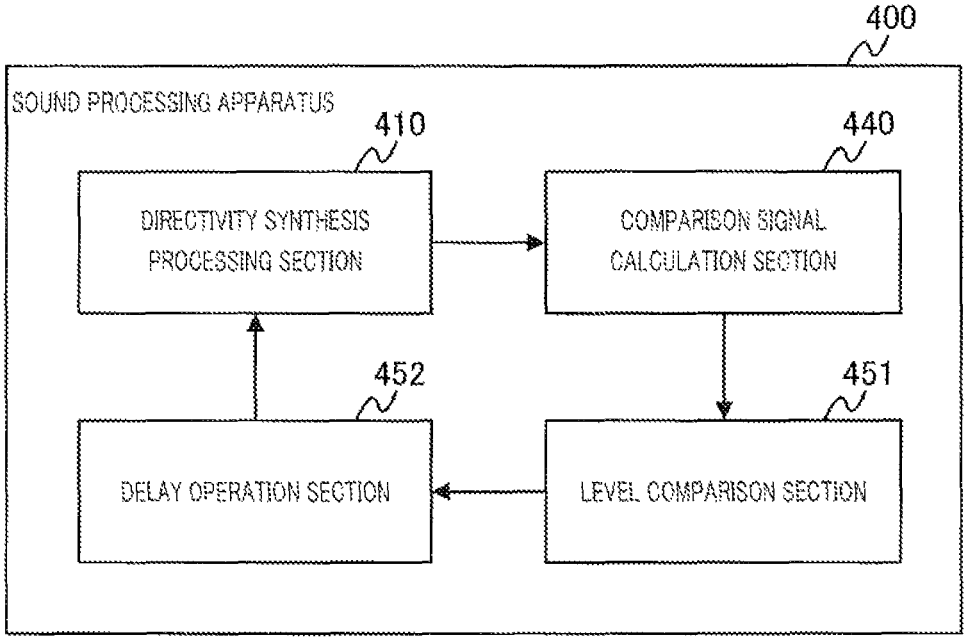
FIG. 1 is a block diagram illustrating a configuration example of a sound processing apparatus according to Embodiment 1 of the present invention.

FIG. 1 is a block diagram illustrating a configuration example of a sound processing apparatus according to the present embodiment.

In FIG. 1, sound processing apparatus 400 is an apparatus that performs directivity synthesis processing of a first picked-up sound signal output from a first sound pickup unit (not illustrated) and a second picked-up sound signal output from a second sound pickup unit (not illustrated). Sound processing apparatus 400 includes directivity synthesis processing section 410, comparison signal calculation section 440, level comparison section 451 and delay operation section 452.

Directivity synthesis processing section 410 generates a first directional picked-up sound signal by delaying the second picked-up sound signal relative to the first picked-up sound signal and combining the first picked-up sound signal with the delayed second picked-up sound signal. In other words, directivity synthesis processing section 410 delays the second picked-up sound signal relative to the first picked-up sound signal and combines the first picked-up sound signal with the second picked-up sound signal so as to make the first directional picked-up sound signal have directivity in a first direction that is a direction on the first sound pickup unit side.

Directivity synthesis processing section 410 also generates a second directional picked-up sound signal by delaying the first picked-up sound signal relative to the second picked-up sound signal and combining the delayed first picked-up sound signal with the second picked-up sound signal. In other words, directivity synthesis processing section 410 delays the first picked-up sound signal relative to the second picked-up sound signal and combines the first picked-up sound signal with the second picked-up sound signal so as to make the second directional picked-up sound signal have directivity in a second direction that is a direction on the second sound pickup unit side.

Comparison signal calculation section 440 generates a non-directional level signal indicating a level of a signal obtained by adding up the first directional picked-up sound signal and the second directional picked-up sound signal. Also, comparison signal calculation section 440 generates a directional level signal obtained by adding up a first level signal indicating a level of the first directional picked-up sound signal and a second level signal indicating a level of the second directional picked-up sound signal.

Level comparison section 451 acquires a level difference between the non-directional level signal and the directional level signal.

Delay operation section 452 adjusts an amount of delay in directivity synthesis processing section 410 so as to reduce the level difference.

Although not illustrated, sound processing apparatus 400 includes, for example, a CPU (central processing unit), a recording medium such as a ROM (read-only memory) that stores a control program and working memory such as a RAM (random access memory). In this case, functions of the respective parts mentioned above are performed by, for example, the CPU executing the control program.

As described above, sound processing apparatus 400 adjusts a delay amount so as to cause no phase reversal of a directional picked-up sound signal that has been made to have directivity in a direction on the side of at least one of sound pickup units.

No occurrence of phase reversal of a directional picked-up sound signal means that an inter-terminal sound distance corresponding to a delay amount is not excessively short relative to an actual inter-terminal sound distance. Accordingly, sound processing apparatus 400 adjusts an amount of delay to a minimum value at which no phase reversal occurs, making it possible to provide an optional directivity pattern with good accuracy, and thus enabling acquisition of required sound with high quality. In other words, sound processing apparatus 400 according to the present embodiment can calculate a correct inter-terminal sound distance to perform processing of picked-up sound signals.

Also, more specifically, sound processing apparatus 400 adjusts a delay amount so as to reduce a level difference between a non-directional level signal and a directional level signal. Consequently, sound processing apparatus 400 can easily adjust the delay amount so as to prevent occurrence of phase reversal. Also, the adjustment can be made if some kind of sound source exists in an axial direction. Accordingly, sound processing apparatus 400 can easily provide an optional directivity pattern with good accuracy and can easily acquire required sound (voice and/or sound) with high quality.

Also, sound processing apparatus 400 can accurately adjust a delay amount by means of the above-described delay amount adjustment. Consequently, sound processing apparatus 400 can easily adjust a delay amount so as to prevent occurrence of phase reversal in an actual environment even when an acoustic change occurs in, e.g., microphones and structures around the microphones and thereby an inter-terminal sound distance changes. Also, the adjustment can be made if some kind of sound source exists in an axial direction. Accordingly, sound processing apparatus 400 can accurately adjust a delay amount in an actual environment even when an acoustic change occurs in, e.g., a structure and/or a position in which microphones are mounted and structures around the microphones.

Embodiment 2

Embodiment 2 of the present invention is an example of a specific mode where the present invention has been applied to a sound pickup device such as a digital camera including two microphones.

In the present embodiment, the sound pickup device has a cardioid directivity characteristic extending in a direction on both sides of a straight line connecting two microphones (axial direction) to pick up sound in stereo.

In a general stereo-microphone, a frequency characteristic corrector (equalizer) for amplifying a low band is provided at an output of a subtractor. However, since superposition of circuit noise has an adverse effect on delay correction processing, a configuration with a frequency characteristic corrector omitted will be described. Also, the components of the sound processing apparatus described below are provided by, for example, hardware including two microphones disposed inside a housing of the sound pickup device, a CPU and recording mediums such as a ROM storing a control program.

<Configuration of Sound Pickup System>

First, a configuration of a sound pickup device including a sound processing apparatus according to the present embodiment will be described.

Figure 2:
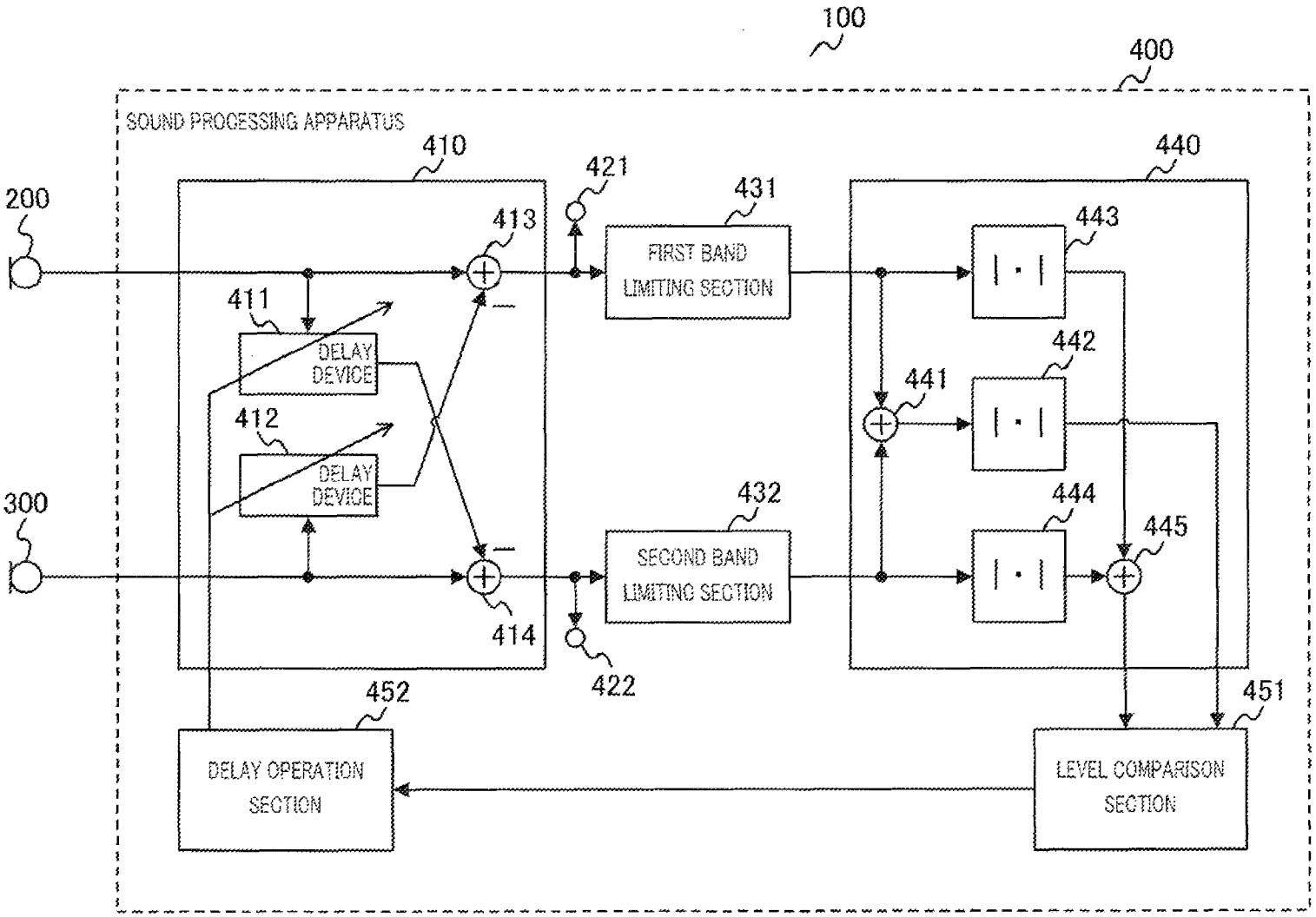
FIG. 2 is a block diagram illustrating a configuration example of a sound pickup device including a sound processing apparatus according to Embodiment 2 of the present invention.

FIG. 2 is a block diagram illustrating a configuration example of a sound pickup device including a sound processing apparatus according to the present embodiment.

In FIG. 2, sound pickup device 100 includes first microphone 200, second microphone 300, and sound processing apparatus 400 according to the present embodiment. First microphone 200, second microphone 300 and sound processing apparatus 400 are disposed inside, for example, a housing (not illustrated) of sound pickup device 100. Also, first microphone 200 and second microphone 300 are disposed at different positions away from each other.

First microphone 200 is a non-directional microphone (first sound pickup unit). First microphone 200 picks up sound and outputs a picked-up sound signal. Hereinafter, a picked-up sound signal output by first microphone 200 is referred to as "first picked-up sound signal."

Second microphone 300 is a non-directional microphone (second sound pickup unit). Second microphone 300 picks up sound and outputs a picked-up sound signal. Hereinafter, a picked-up sound signal output by second microphone 300 is referred to as "second picked-up sound signal."

In the present embodiment, it is assumed that an actual inter-terminal sound distance between first microphone 200 and second microphone 300 is 10 mm (millimeters). This value is initially unknown.

Sound processing apparatus 400 receives as input a first picked-up sound signal and a second picked-up sound signal. Then, sound processing apparatus 400 performs directivity synthesis processing of the first picked-up sound signal and the second picked-up sound signal.

More specifically, sound processing apparatus 400 includes directivity synthesis processing section 410, first signal output section 421, second signal output section 422, first band limiting section 431, second band limiting section 432, comparison signal calculation section 440, level comparison section 451 and delay operation section 452.

Directivity synthesis processing section 410 generates a first directional picked-up sound signal having directivity in a first direction that is a direction on the first sound pickup unit side, by delaying the second picked-up sound signal relative to the first picked-up sound signal and combining the first picked-up sound signal with the delayed second picked-up sound signal. Also, directivity synthesis processing section 410 generates a second directional picked-up sound signal having directivity in a second direction that is a direction on the second sound pickup unit side, by delaying the first picked-up sound signal relative to the second picked-up sound signal and combining the delayed first picked-up sound signal with the second picked-up sound signal. In other words, directivity synthesis processing section 410 generates two directional picked-up sound signals having directivity characteristics that are symmetrically arranged along the axial directions, from the first picked-up sound signal and the second picked-up sound signal.

More specifically, directivity synthesis processing section 410 includes first delay device 411, second delay device 412, first adder 413, and second adder 414.

First delay device 411 receives the first picked-up sound signal as input. Then, first delay device 411 outputs a first delayed picked-up sound signal obtained by delaying the first picked-up sound signal.

Second delay device 412 receives as input the second picked-up sound signal. Then, second delay device 412 outputs a second delayed picked-up sound signal obtained by delaying the second picked-up sound signal.

The amount of delay of the first delayed picked-up sound signal relative to the first picked-up sound signal and the amount of delay of the second delayed picked-up sound signal relative to the second picked-up sound signal are each adjustable by delay operation section 452 described later.

First adder 413 receives as input the first picked-up sound signal and the second delayed picked-up sound signal with their polarity reversed. Then, first adder 413 adds up the first picked-up sound signal and the second delayed picked-up sound signal with their polarity reversed and outputs a first directional picked-up sound signal, which is a result of the addition.

Second adder 414 receives as input the second picked-up sound signal and the first delayed picked-up sound signal with their polarity reversed. Then, second adder 414 adds up the second picked-up sound signal and the first delayed picked-up sound signal with their polarity reversed and outputs a second directional picked-up sound signal, which is a result of the addition.

First signal output section 421 receives as input the first directional picked-up sound signal and outputs the first directional picked-up sound signal to the outside of sound processing apparatus 400.

Second signal output section 422 receives as input the second directional picked-up sound signal and outputs the second directional picked-up sound signal to the outside of sound processing apparatus 400.

First band limiting section 431 receives as input the first directional picked-up sound signal. Then, first band limiting section 431 outputs a signal obtained by limiting a band of the first directional picked-up sound signal and outputs the signal to comparison signal calculation section 440. In other words, first band limiting section 431 limits the band of the first directional picked-up sound signal to be input to comparison signal calculation section 440 to a frequency band in which no spatial aliasing occurs even when the amount of delay is varied.

Second band limiting section 432 receives as input the second directional picked-up sound signal. Then, second band limiting section 432 outputs a signal obtained by limiting a band of the second directional picked-up sound signal to comparison signal calculation section 440. In other words, second band limiting section 432 limits the band of the second directional picked-up sound signal to be input to comparison signal calculation section 440 to a frequency band in which no spatial aliasing occurs even when the amount of delay is varied.

The above band limitation is performed in order to prevent a spatial aliasing phenomenon from adversely affecting the delay amount adjustment. Spatial aliasing occurs due to phase interference of an incident wave with a relatively-high frequency when directivity synthesis processing is performed, and is a phenomenon that provides a directional picked-up sound signal gain in an unintended direction.

The method of band limitation is not limited to any specific method. The band limitation can be performed by means of, for example, a bandpass filter that provides time-domain filtering. Alternatively, in the band limitation, windowing of each of a certain number of samples is performed with the samples overlapping one another to perform a frequency analysis using FFT (fast Fourier transform). Furthermore, the band limitation can be provided by extracting a complex spectrum signal corresponding to a desired frequency. Details of the limited frequency bands in first band limiting section 431 and second band limiting section 432 will be described later.

Comparison signal calculation section 440 receives as input the first directional picked-up sound signal subjected to the band limitation by first band limiting section 431 and the second directional picked-up sound signal subjected to the band limitation by second band limiting section 432.

Hereinafter, the first directional picked-up sound signal subjected to the band limitation by first band limiting section 431 is referred to as "band-limited first directional picked-up sound signal." Also, the second directional picked-up sound signal subjected to the band limitation by second band limiting section 432 is referred to as "band-limited second directional picked-up sound signal."

Then, comparison signal calculation section 440 generates two types of level signals, which are a non-directional level signal and a directional level signal, from the band-limited first directional picked-up sound signal and the band-limited second directional picked-up sound signal, and outputs the level signals.

The non-directional level signal is a signal indicating a level of a signal obtained by adding up the band-limited first directional picked-up sound signal and the band-limited second directional picked-up sound signal. The directional level signal is a signal obtained by adding up a first level signal indicating a level of the band-limited first directional picked-up sound signal and a second level signal indicating a level of the band-limited second directional picked-up sound signal.

More specifically, comparison signal calculation section 440 includes third adder 441, first level signal calculation section 442, second level signal calculation section 443, third level signal calculation section 444 and fourth adder 445.

Third adder 441 receives as input the band-limited first directional picked-up sound signal and the band-limited second directional picked-up sound signal. Then, third adder 441 adds up the band-limited first directional picked-up sound signal and the band-limited second directional picked-up sound signal.

First level signal calculation section 442 receives an output signal from third adder 441 as input. Then, first level signal calculation section 442 extracts level information from the output signal of third adder 441 and converts the output signal of third adder 441 into a non-directional level signal.

Second level signal calculation section 443 receives the band-limited first directional picked-up sound signal as input. Then, second level signal calculation section 443 extracts level information from the band-limited first directional picked-up sound signal and converts the band-limited first directional picked-up sound signal into a first level signal.

Third level signal calculation section 444 receives the band-limited second directional picked-up sound signal as input. Then, third level signal calculation section 444 extracts level information from the band-limited second directional picked-up sound signal and converts the band-limited second directional picked-up sound signal into a second level signal.

Fourth adder 445 receives the first level signal and the second level signal as input. Then, fourth adder 445 adds up the first level signal and the second level signal, and outputs a directional level signal, which is a result of the addition.

If an input signal is a waveform signal such as an output from a bandpass filter, each of first to third level signal calculation sections 442 to 444 extracts an absolute value or a square value of the input signal as level information.

Also, if an input signal is a complex spectrum signal provided using, e.g., FFT, each of first to third level signal calculation sections 442 to 444 extracts an amplitude spectrum of the input signal or a power spectrum of the input signal as level information.

If a complex spectrum signal for one frequency bin is input, each of first to third level signal calculation sections 442 to 444 may extract an amplitude spectrum or a power spectrum thereof without modification, as level information. Also, if a frequency spectrum signal having a plurality of bands is input, each of first to third level signal calculation sections 442 to 444 may extract an average value of amplitudes for each frequency bin or an average value of power spectrums for each frequency bin as level information.

Level comparison section 451 receives as input the non-directional level signal and the directional level signal, and obtains a level difference between these level signals. The level difference is, for example, a ratio in level between the non-directional level signal and the directional level signal or a difference between the non-directional level signal and the directional level signal.

Delay operation section 452 adjusts the delay amounts in first delay device 411 and second delay device 412 in directivity synthesis processing section 410 so as to reduce the level difference. More specifically, delay operation section 452 increases the delay amount in each of first delay device 411 and second delay device 412 from a sufficiently-small value in a stepwise manner. Then, delay operation section 452 fixes the delay amount of each of first delay device 411 and second delay device 412 at a delay amount when the level difference reaches a predetermined value. A relationship between the delay amount and the first directional picked-up sound signal and details of the level difference and the predetermined value, which serves as a basis for the level difference, will be described later.

The description of the configuration of sound pickup device 100 has been given thus far.

<Frequency Amplitude Characteristics of Directional Picked-Up Sound Signals>

Next, details of the limited frequency bands in first band limiting section 431 and second band limiting section 432 will be described. As described above, the band limitation is performed in order to reduce the influence of an aliasing phenomenon on the delay amount adjustment.

Figure 3:
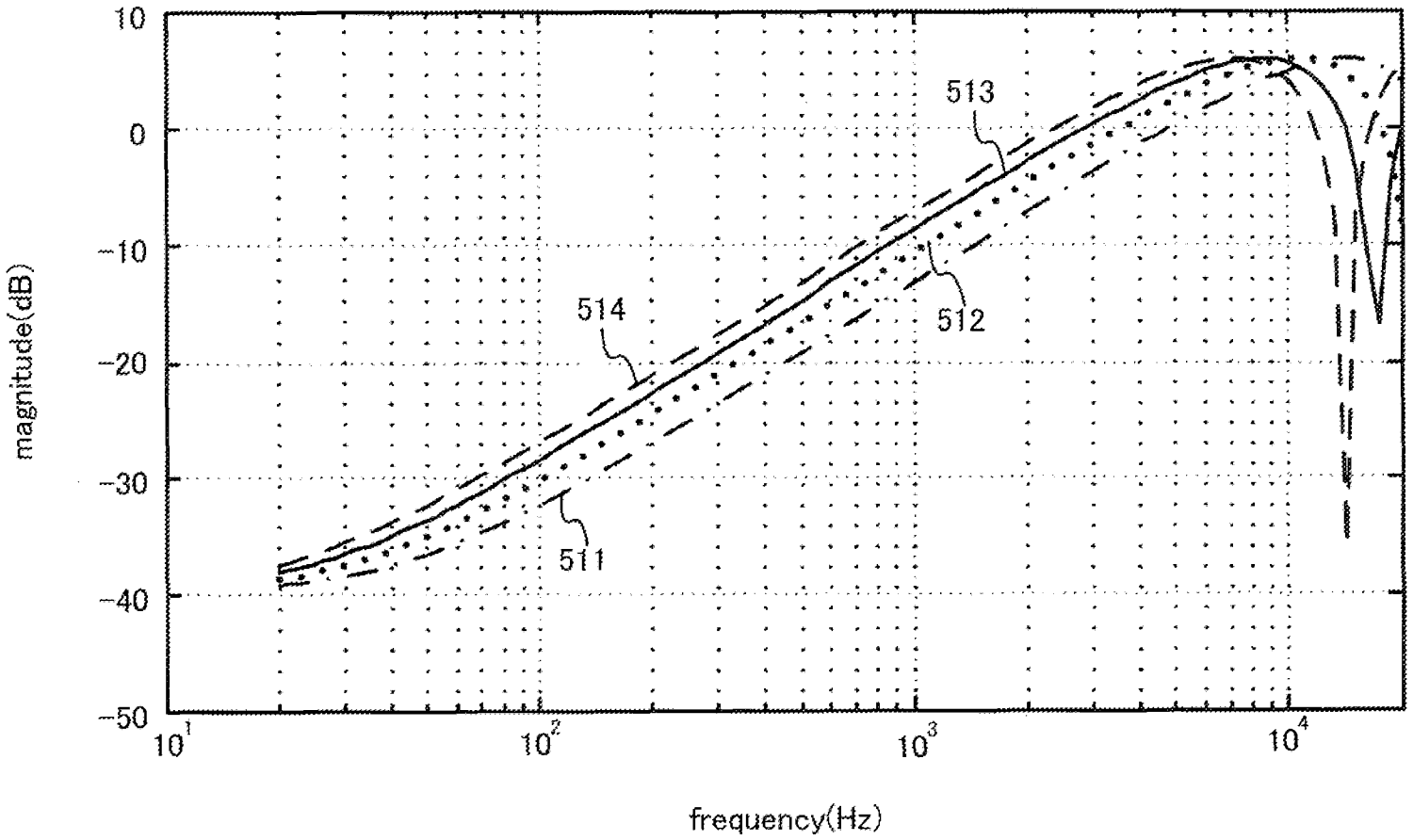
FIG. 3 is a diagram illustrating results of simulations of frequency amplitude characteristics of first directional picked-up sound signals in Embodiment 2 of the present invention.
Figure 4:
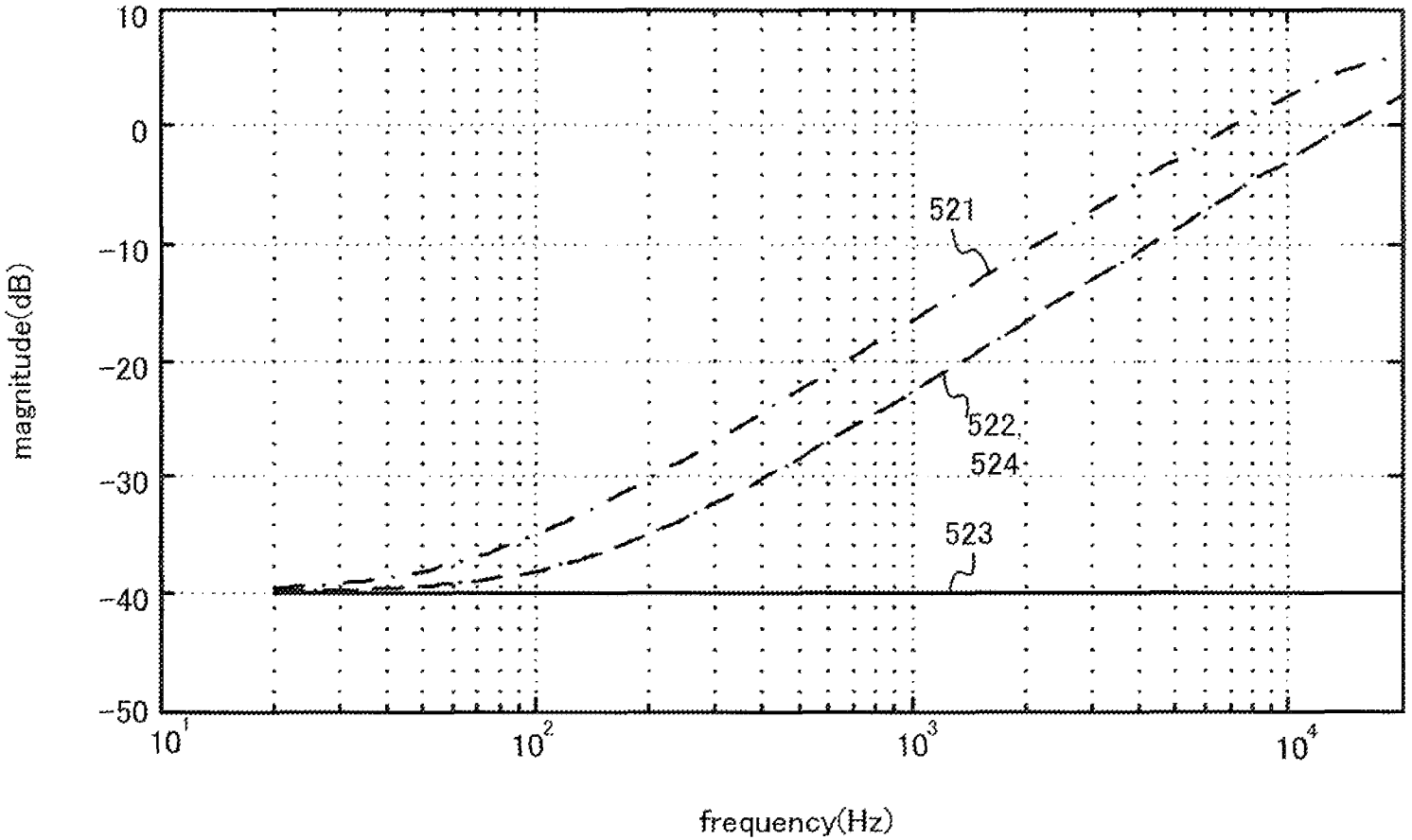
FIG. 4 is a diagram illustrating results of simulations of frequency amplitude characteristics of second directional picked-up sound signals in Embodiment 2 of the present invention.

FIG. 3 is a diagram illustrating results of simulations of frequency amplitude characteristics of first directional picked-up sound signals. Also, FIG. 4 is a diagram illustrating results of simulations of frequency amplitude characteristics of second directional picked-up sound signals.

The drawings indicate the output levels at respective frequencies where the delay amount is varied to a delay amount corresponding to 6 mm, a delay amount corresponding to 10 mm, and a delay amount corresponding to 14 mm with a sound source disposed in a direction on first microphone 200 side from among the axial directions.

The delay amount corresponding to 6 mm is a delay amount for an inter-terminal sound distance of 6 mm, which is a value smaller than a value corresponding to an actual inter-terminal sound distance (hereinafter referred to as "proper value"). The delay amount for 10 mm is a delay amount for an inter-terminal sound distance of 10 mm, which is a proper value. The delay amount corresponding to 14 mm is a delay amount for an inter-terminal sound distance of 14 mm, which is a value larger than a proper value.

In FIG. 3, lines 511 to 514 indicate frequency amplitude characteristics of first directional picked-up sound signals with the delay amount corresponding to 2 mm, the delay amount corresponding to 6 mm, the delay amount corresponding to 10 mm and the delay amount corresponding to 14 mm, respectively.

Also, in FIG. 4, lines 521 to 524 indicate frequency amplitude characteristics of second directional picked-up sound signals with the delay amount corresponding to 2 mm, the delay amount corresponding to 6 mm, the delay amount corresponding to 10 mm, and the delay amount corresponding to 14 mm, respectively.

Although first microphone 200 and second microphone 300 are used with their sensitivities corrected, in actual use, it is difficult to avoid inclusion of a residual sensitivity error. Accordingly, here, a case where a second picked-up sound signal includes a microphone output sensitivity error of −0.087 dB (0.99 times) relative to a first picked-up sound signal is indicated as an example.

In this case, sound comes from the direction on first microphone 200 side from among the axial directions. Accordingly, where a second delay amount that is a proper value is set, as indicated by line 523 in FIG. 4, the output level of the second directional picked-up sound signal becomes a value close to zero in amplitude value equivalent irrespective of the frequencies. Here, because of an influence of a sensitivity difference between the microphones, a logarithmic amplitude is indicated by −40 dB. On the other hand, if a first or third delay amount that is not a proper value is set, as indicated by lines 521, 522 and 524 in FIG. 4, an output level of each second directional picked-up sound signal has a high value in an almost entire high frequency band.

However, as indicated by lines 511 to 514 in FIG. 3, in the output level of each first directional picked-up sound signal, deterioration in characteristic (output level drop) occurs due to the influence of spatial aliasing in a highest band (7 kHz or higher) in the high frequency band. Spatial aliasing is related to, e.g., a distance between the microphones and/or an adjusted delay amount range.

If the sound source is disposed on second microphone 300 side from among the axial directions, the same as above may occur also in the output level of the second directional picked-up sound signal.

Thus, sound processing apparatus 400 limits signals to be subjected to delay processing to a frequency band in which no deterioration occurs in a polar pattern thereof in first band limiting section 431 and second band limiting section 432.

The examples in which a sound source is disposed in an axial direction, which are illustrated in FIGS. 3 and 4, correspond to a condition in which an inter-terminal sound distance becomes maximum, that is, a condition in which a frequency limitation condition becomes most strict. Accordingly, it is desirable that limited frequency bands in first band limiting section 431 and second band limiting section 432 be set so as to reduce the influence of spatial aliasing that occurs where a sound source is disposed in an axial direction. In other words, it is desirable that the limited frequency bands be set within a range in which the following signal comparison is performed in a favorable manner. Accordingly, a passband is set to a frequency band in which no spatial aliasing occurs in a frequency region in which the output level increases as the frequency increases.

The description of details of the limited frequency bands in first band limiting section 431 and second band limiting section 432 has been given thus far.

<Delay Amount-Directivity Pattern Characteristic Relationship>

Next, a relationship between a delay amount and first directional picked-up sound signal (and second directional picked-up sound signal) will be described.

Figure 5:
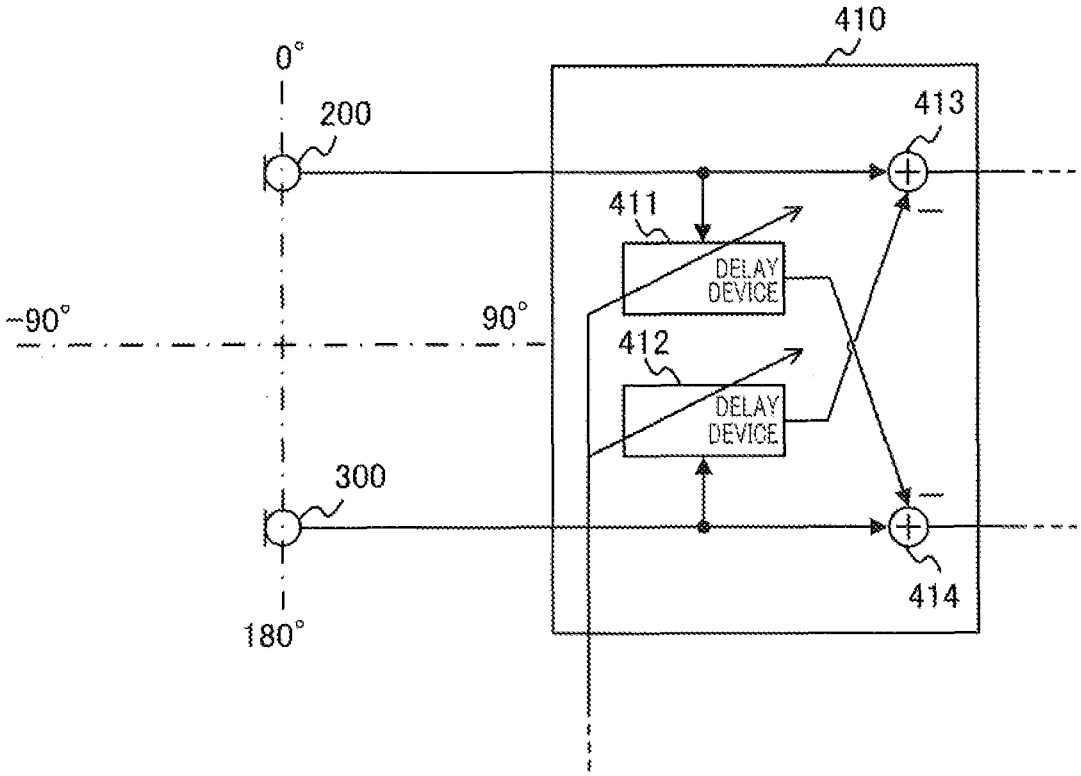
FIG. 5 is a diagram illustrating definitions of directions in Embodiment 2 of the present invention.

FIG. 5 is a diagram indicating definitions of directions in the below description.

As illustrated in FIG. 5, the definitions of directions are provided on the premise that a direction on first microphone 200 side from among axial directions, which are directions on a straight line connecting first microphone 200 and second microphone 300 is 0° (degrees). Then, definitions of angles are provided in a clockwise manner viewed from the above in a normal use situation.

First microphone 200 and second microphone 300 are equal to each other in microphone sensitivity.

Figure 6:
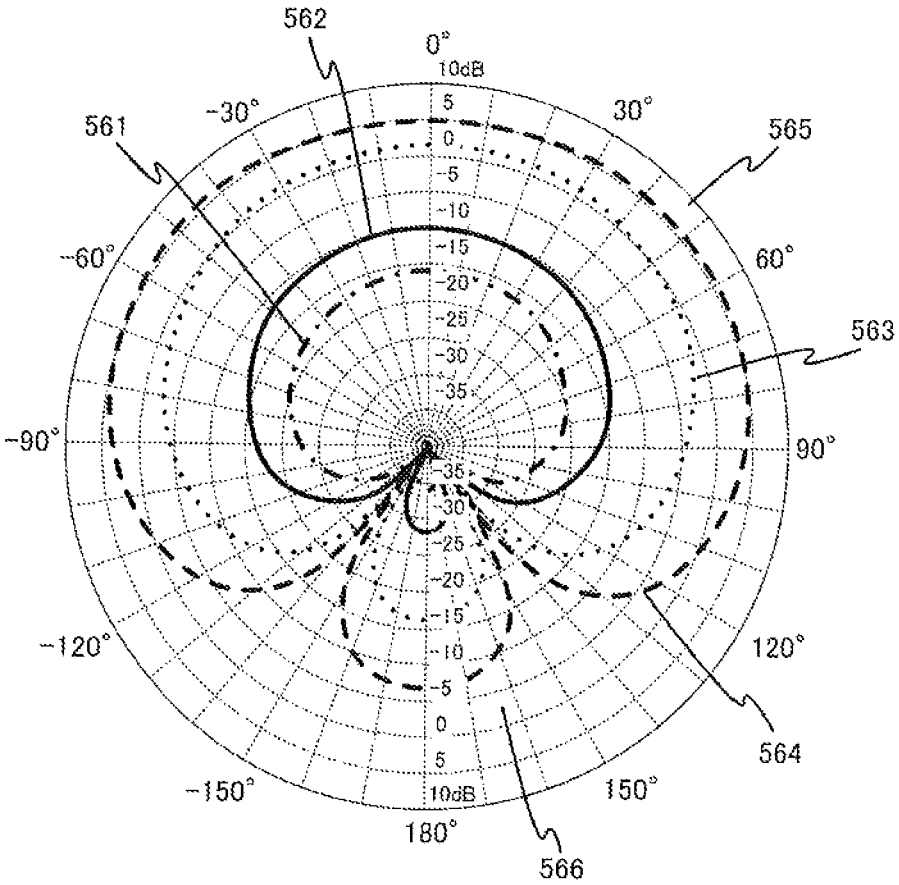
FIG. 6 is a diagram illustrating results of simulations of polar patterns of first directional picked-up sound signals where a delay amount in a second delay device is small in Embodiment 2 of the present invention.
Figure 7:
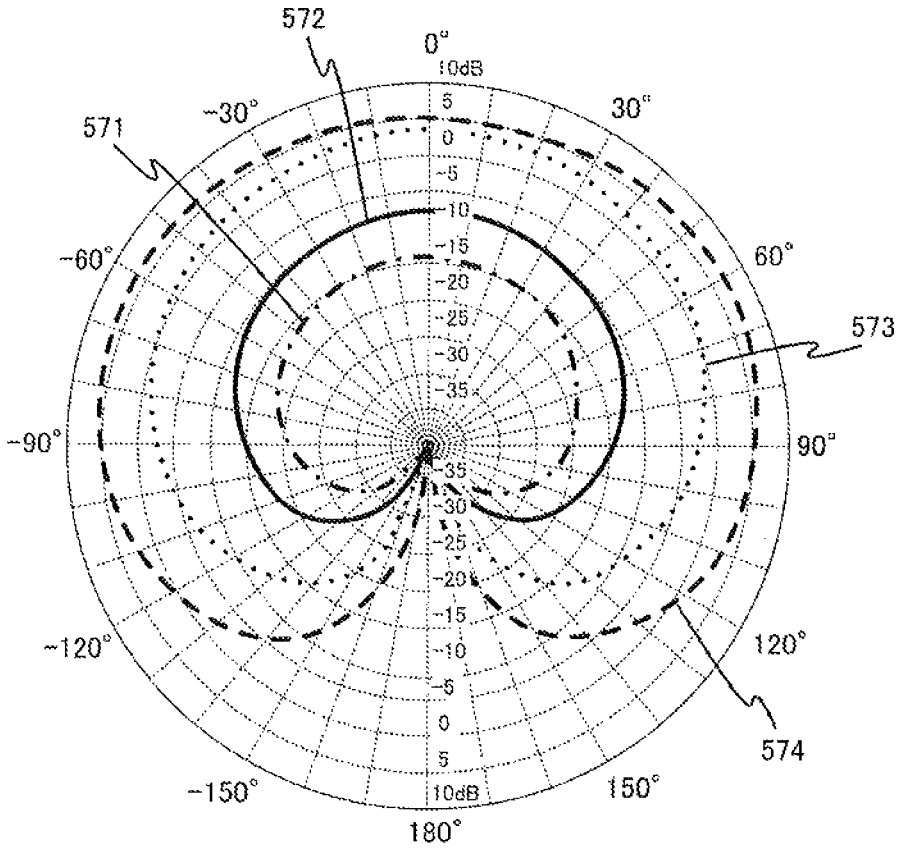
FIG. 7 is a diagram illustrating results of simulations of polar patterns of first directional picked-up sound signals where a delay amount in the second delay device is a proper value, in Embodiment 2 of the present invention.
Figure 8:
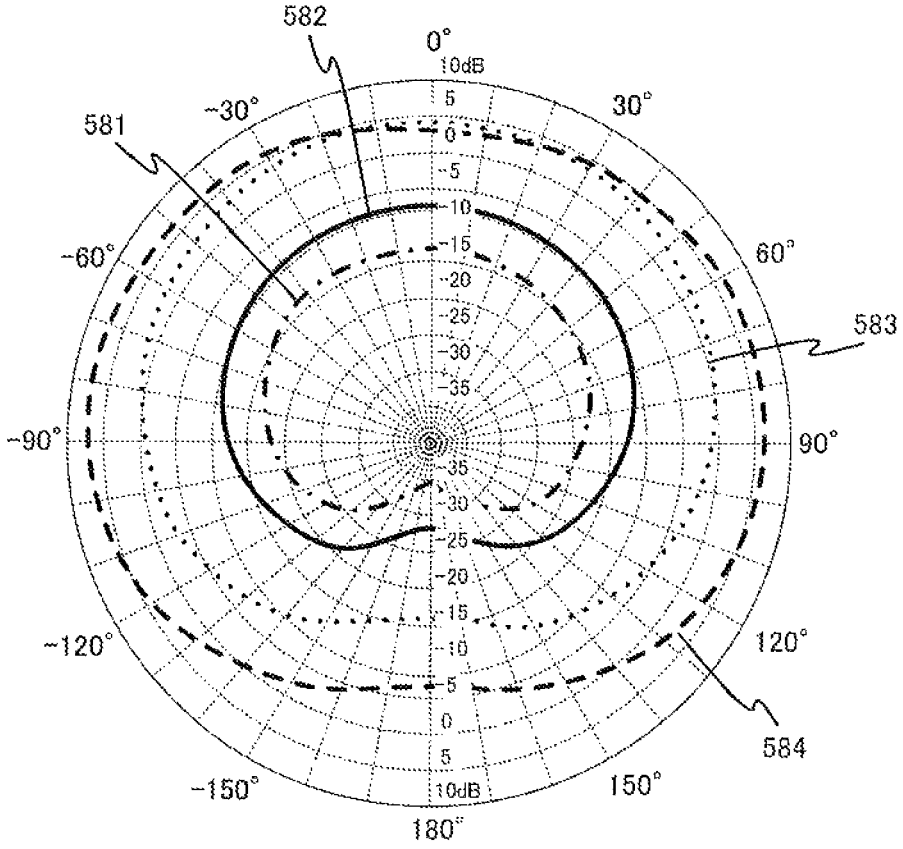
FIG. 8 is a diagram illustrating results of simulations of polar patterns of first directional picked-up sound signals where a delay amount in the second delay device is large in Embodiment 2 of the present invention.

Each of FIGS. 6 to 8 is a diagram illustrating results of simulations of polar patterns (directivity patterns) of first directional picked-up sound signals where an amount of delay in second delay device 412 is varied.

FIG. 6 indicates polar patterns where the amount of delay in second delay device 412 is a delay amount corresponding to 8 mm FIG. 7 indicates polar patterns where the amount of delay in second delay device 412 is a delay amount corresponding to 10 mm (that is, a proper value). FIG. 8 indicates polar patterns where the amount of delay in second delay device 412 is a delay amount corresponding to 12 mm.

In FIG. 6, lines 561 to 564 indicate polar patterns of first directional picked-up sound signals of 500 Hz (hertz), 1,000 Hz, 4,000 Hz and 12,000 Hz, respectively.

In FIG. 7, lines 571 to 574 indicate polar patterns of first directional picked-up sound signals of 500 Hz, 1,000 Hz, 4,000 Hz and 12,000 Hz, respectively.

In FIG. 8, lines 581 to 584 indicate polar patterns of first directional picked-up sound signals of 500 Hz, 1,000 Hz, 4,000 Hz and 12,000 Hz, respectively.

As indicated by lines 561 to 564 in FIG. 6, if the amount of delay in second delay device 412 is smaller than a proper value, a polar pattern has side lobe 566 extending in a 180° direction in addition to main lobe 565 extending in a 0° direction. In other words, the directivity characteristic is different from the later-described cardioid characteristic. Here, a phase of side lobe 566 is reverse of a phase of main lobe 565. Such side lobe having a negative phase is referred to as "negative lobe" below.

As indicated by lines 571 to 574 in FIG. 7, if the amount of delay in second delay device 412 is a proper value, a polar pattern only has a main lobe with no negative lobe. In addition, a value in the 180° direction of the main lobe is almost zero in amplitude value equivalent (−∞ in logarithmic amplitude equivalent).

As indicated by lines 581 to 584 in FIG. 8, if the amount of delay in second delay device 412 is larger than a proper value, a polar pattern has no negative lobe and only has a main lobe. However, a value in the 180° direction of the main lobe is not zero in amplitude value equivalent (−∞ in logarithmic amplitude equivalent).

Figure 9:
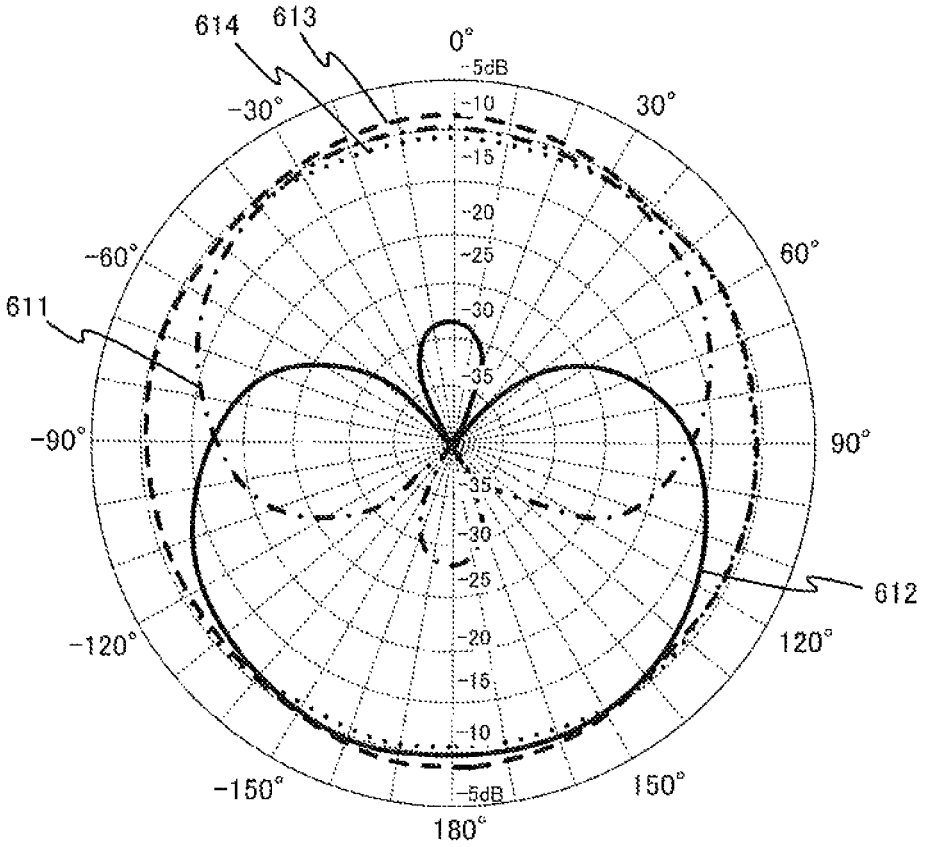
FIG. 9 is a diagram illustrating results of simulations of a polar pattern of a non-directional level signal and a polar pattern of a directional level signal where a delay amount in the second delay device is small in Embodiment 2 of the present invention.
Figure 10:
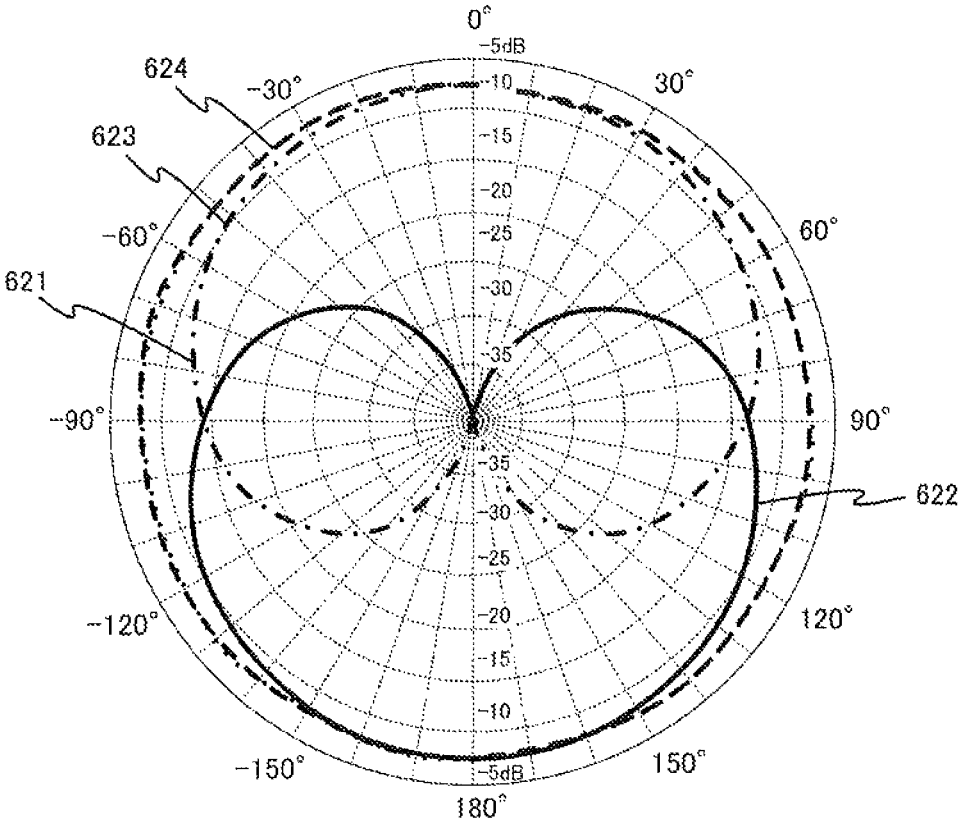
FIG. 10 is a diagram illustrating results of simulations of a polar pattern of a non-directional level signal and a polar pattern of a directional level signal where a delay amount in the second delay device is a proper value in Embodiment 2 of the present invention.
Figure 11:
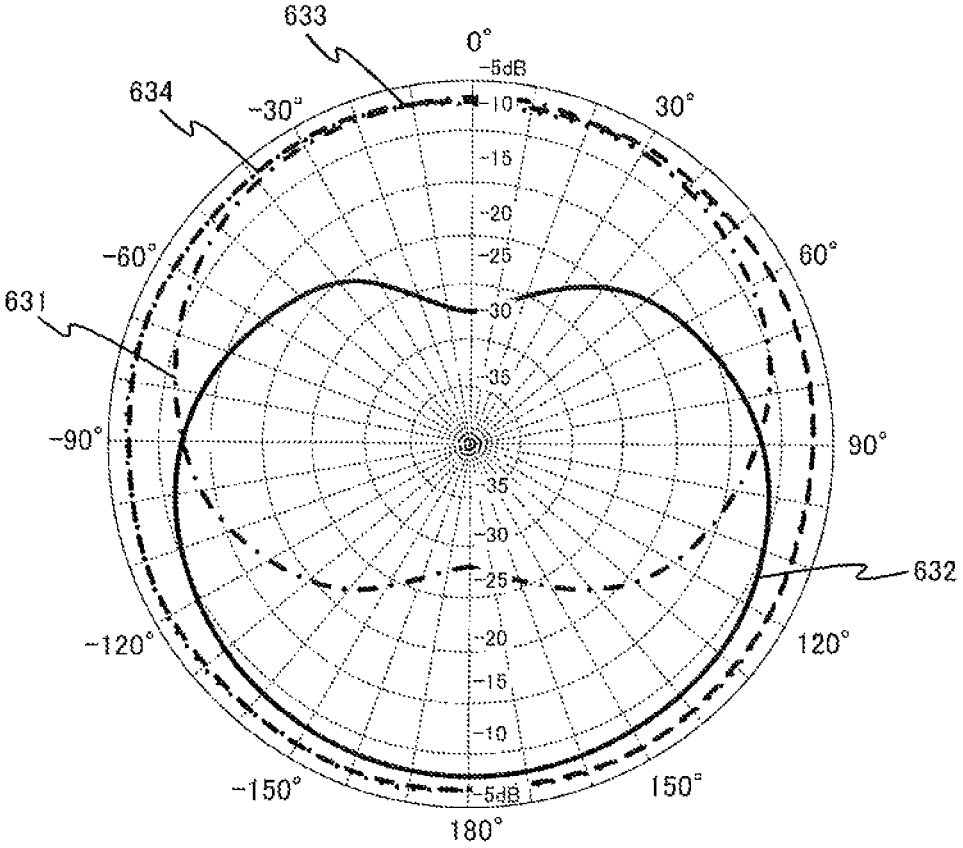
FIG. 11 is a diagram illustrating results of simulations of a polar pattern of a non-directional level signal and a polar pattern of a directional level signal where a delay amount in the second delay device is large in Embodiment 2 of the present invention.

FIGS. 9 to 11 each illustrate results of simulations of a polar pattern of a non-directional level signal and a polar pattern of a directional level signal for 1 kHz where the amount of delay in first delay device 411 and the amount of delay in second delay device 412 are varied.

Here, the same value is set for each of the amount of delay in first delay device 411 and the amount of delay in second delay device 412, which are simply referred to as "delay amount."

FIG. 9 illustrates a polar pattern where the delay amount in second delay device 412 is a delay amount corresponding to 8 mm. FIG. 10 illustrates a polar pattern where the delay amount in second delay device 412 is a delay amount corresponding to 10 mm (that is, a proper value). FIG. 11 illustrates a polar pattern where the delay amount in second delay device 412 is a delay amount corresponding to 12 mm.

In FIG. 9, lines 611 to 614 indicate a polar pattern of a first directional picked-up sound signal, a polar pattern of a second directional picked-up sound signal, a polar pattern of a directional level signal and a polar pattern of a non-directional level signal, respectively.

In FIG. 10, lines 621 to 624 indicate a polar pattern of a first directional picked-up sound signal, a polar pattern of a second directional picked-up sound signal, a polar pattern of a directional level signal and a polar pattern of a non-directional level signal, respectively.

In FIG. 11, lines 631 to 634 indicate a polar pattern of a first directional picked-up sound signal, a polar pattern of a second directional picked-up sound signal, a polar pattern of a directional level signal and a polar pattern of a non-directional level signal, respectively.

As indicated by lines 611 and 612 in FIG. 9, where the delay amount is smaller than a proper value, each of the first directional picked-up sound signal and the second directional picked-up sound signal has a negative lobe. Accordingly, as indicated by lines 613 and 614 in FIG. 9, a discrepancy occurs between the polar pattern of the directional level signal and the polar pattern of the non-directional level signal, and the discrepancy is largest in the axial directions (0° and 180°).

As indicated by lines 621 and 622 in FIG. 10, if the delay amount is a proper value, each of the first directional picked-up sound signal and the second directional picked-up sound signal has no negative lobe. Accordingly, as indicated by lines 623 and 624 in FIG. 10, the polar pattern of the directional level signal and the polar pattern of the non-directional level signal agree with each other in all directions.

As indicated by lines 631 and 632 in FIG. 11, if the delay amount is larger than a proper value, each of the first directional picked-up sound signal and the second directional picked-up sound signal has no negative lobe. Accordingly, as indicated by lines 633 and 634 in FIG. 11, the polar pattern of the directional level signal and the polar pattern of the non-directional level signal agree with each other in all directions. Note that the first directional picked-up sound signal and the second directional picked-up sound signal each have a directivity characteristic that is somewhat close to non-directivity because of the cardioid characteristic.

The description of the relationship between delay amount and first directional picked-up sound signal (and second directional picked-up sound signal) has been given thus far.

<Delay Amount-Level Difference Relationship>

Next, a level difference and a predetermined value that serves as a basis for the level difference will be described.

As is clear from FIGS. 6 to 8 described above, if a delay amount corresponding to or exceeding an inter-terminal sound distance is provided in second delay device 412, no negative lobe occurs substantially. Also, if a smaller delay amount is provided in second delay device 412, shaper directivity is maintained. Conversely, a smallest possible value of delay amount in a range in which no negative lobe occurs can be regarded as a proper value for the delay amount in second delay device 412.

Then, as is clear from FIGS. 9 to 11, whether or not a negative lobe has occurred can be determined based on whether or not a non-directional level signal and a directional level signal agree with each other.

Therefore, in a situation in which some kind of sound source exists in an axial direction, sound processing apparatus 400 increases the delay amount from a value that is sufficiently smaller than a value corresponding to a minimum value of a predicted inter-terminal sound distance, in a stepwise manner. Then, when the non-directional level signal and the directional level signal agree with each other, sound processing apparatus 400 fixes the delay amount. Consequently, sound processing apparatus 400 can set the delay amount to a proper value corresponding to an actual inter-terminal sound distance.

More specifically, in each of steps in which the delay amount increases, if the level ratio between the non-directional level signal and the directional level signal is used, level comparison section 451 calculates level difference cmp_inf using, for example, equation 1 below. Here, sum_abs denotes a directional level signal value, and omni_abs denotes a non-directional level signal value. Then, if level difference cmp_inf becomes zero, delay operation section 452 fixes the delay amount.

[1]

$$\text{cmp_inf} = 20\log_{10}\left(\frac{\text{sum_abs}}{\text{omni_abs}}\right) \quad \text{(Equation 1)}$$

If the level difference between the non-directional level signal and the directional level signal is used, level comparison section 451 calculates level difference cmp_inf using, for example, equation 2 below.

[2]

$$\text{cmp_inf}=\text{sum_abs}-\text{omni_abs} \quad \text{(Equation 2)}$$

Agreement between directional level signal value sum_abs and non-directional level signal value omni_abs has the same meaning as a negative lobe existing in neither the directivity characteristic of the first directional picked-up sound signal nor the directivity characteristic of the second directional picked-up sound signal. In other words, agreement between directional level signal value sum_abs and non-directional level signal value omni_abs is equivalent to satisfaction of equations 3 and 4 below for all frequencies ω and all directions (incident angles of sound) θ. Here, A (ω, θ) indicates an output characteristic of the first directional picked-up sound signal, and B (ω, θ) indicates an output characteristic B (ω) of the second directional picked-up sound signal. Also, sgn( ) indicates a symbol for a value in brackets.

[3]

$$|A(\omega,\theta)+B(\omega,\theta)|=|A(\omega,\theta)+|B(\omega,\theta)| \quad \text{(Equation 3)}$$

[4]

$$\text{sgn}(A(\omega,\theta))=\text{sgn}(B(\omega,\theta)) \quad \text{(Equation 4)}$$

As already illustrated in FIG. 2, directivity synthesis processing section 410 is configured to generate a non-directional level signal corresponding to the left-hand side of equation 3 and a directional level signal corresponding to the right-hand side of equation 3.

On the other hand, actually, there is a sensitivity error between first microphone 200 and second microphone 300. Thus, even when the delay amount is a proper value, a non-directional level signal and a directional level signal do not completely agree with each other in many cases. Examples of factors of the sensitivity error may include a sensitivity difference between first microphone 200 and second microphone 300 and uncorrelated noise existing between the first picked-up sound signal and the second picked-up sound signal. Examples of the uncorrelated noise include, e.g., circuit noise, wind noise and vibration noise.

Figure 12:
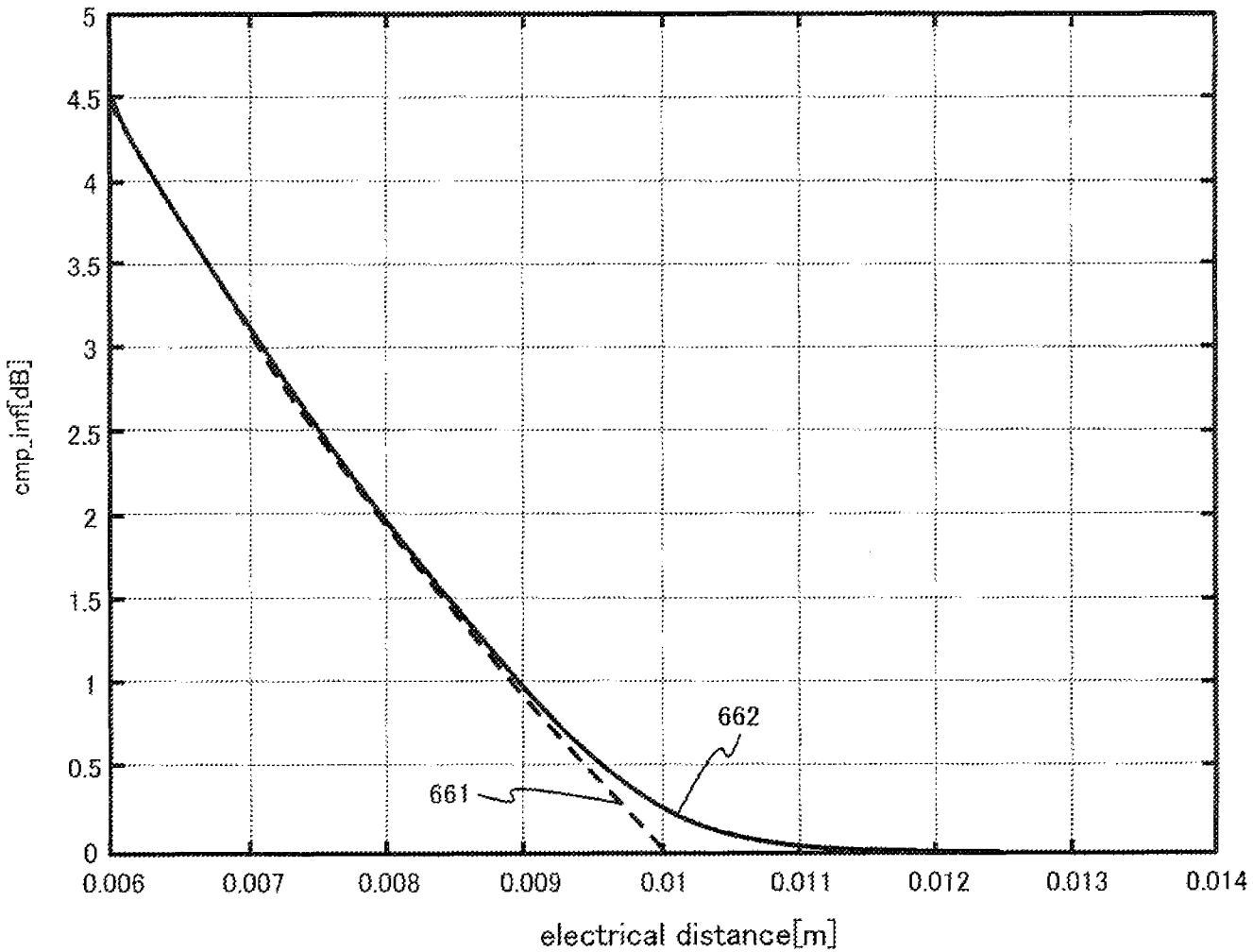
FIG. 12 is a diagram illustrating an influence of sensitivity error on a delay amount-level difference relationship in Embodiment 2 of the present invention.

FIG. 12 is a diagram illustrating the influence of a sensitivity error on a delay amount-level difference relationship. In FIG. 12, the abscissa axis indicates the delay amount in terms of inter-terminal sound distance (electrical distance) [m] corresponding to the delay amount. In FIG. 12, the ordinate axis indicates level difference cmp_inf [dB] calculated according to equation 1 above. Here, the delay amount-level difference relationship at a frequency of 1 kHz where the actual inter-terminal sound distance is 10 mm (0.01 m) and the sound source is positioned in the 0° direction is indicated.

In FIG. 12, line 661 indicates a delay amount-level difference relationship where there is no sensitivity error between first microphone 200 and second microphone 300. Then, line 662 indicates a delay amount-level difference relationship where second microphone 300 has a sensitivity error of −0.087 dB relative to first microphone 200.

As illustrated in FIG. 12, if there is no sensitivity error, as the delay amount increases, the level difference decreases and decreases to 0 dB when the delay amount reaches a value corresponding to an inter-terminal sound distance of 10 mm.

However, as illustrated in FIG. 12, if there is a sensitivity error, the level difference does not completely become 0 dB even when the delay amount reaches a value corresponding to an inter-terminal sound distance of 10 mm. In other words, the delay amount may become larger than a proper value if a criterion for determination of fixing the delay amount is set as level difference=0.

Accordingly, if a sensitivity error is known in advance, it is desirable to determine a threshold value that serves as a criterion for determination of fixing a delay amount, in consideration of the sensitivity error.

Here, an example of a method for determining a threshold value that serves as a criterion for determination of fixing a delay amount will be described. Here, it is assumed that a sound source is disposed in such a manner that the sound source is fixed in the 0° direction (see FIG. 5).

It is assumed that second microphone 300 has a a-fold amplitude gain relative to first microphone 200. In this case, output characteristic A (ω) of the first directional picked-up sound signal and output characteristic B (ω) of the second directional picked-up sound signal can be expressed by equations 5 and 6 below. In the equations, co is a frequency of an input signal, and τ is a delay amount [sec] in first delay device 411 and second delay device 412.

[5]

$$A(\omega)=1-a\cdot\exp(-j\omega\tau) \quad \text{(Equation 5)}$$

[6]

$$B(\omega)=-\exp(-j\omega\tau)+a\cdot\exp(-j\omega\tau) \quad \text{(Equation 6)}$$

Also, directional level signal value sum_abs (ω) and non-directional level signal value omni_abs (ω) can be expressed by equations 7 and 8 below.

[7]

$$\text{omni_abs}(\omega)=|A(\omega)+B(\omega)| \quad \text{(Equation 7)}$$

[8]

$$\text{sum_abs}(\omega)=|A(\omega)|+|B(\omega)| \quad \text{(Equation 8)}$$

Figure 13:
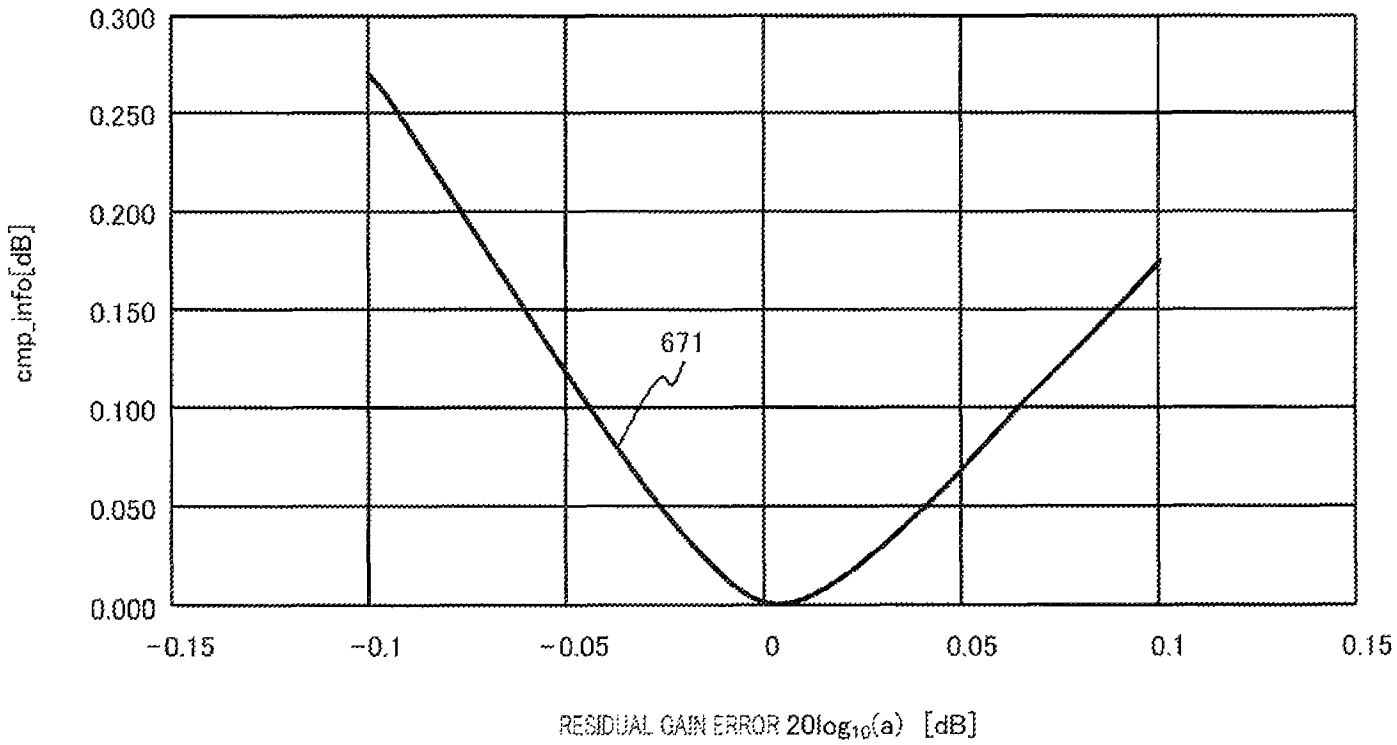
FIG. 13 is a diagram illustrating a residual gain error-level difference relationship in Embodiment 2 of the present invention.

FIG. 13 is a diagram illustrating a residual gain error-level difference relationship. In FIG. 13, the abscissa axis indicates residual gain error between first microphone 200 and second microphone 300 in terms of 20 $\log_{10}$(a) [dB] using amplitude gain a above. In FIG. 13, the ordinate axis indicates level difference cmp_inf [dB] calculated according to equation 1 above.

In FIG. 13, line 671 indicates level difference cmp_inf at 1 kHz when equations 5 to 8 are assigned to equation 1. As illustrated in FIG. 13, for example, if there is a residual gain error within ±0.1 dB, level difference cmp_inf is not greater than 0.2. Accordingly, in this case, it would appear that if a threshold value that serves as a criterion for determination of fixing a delay amount is set to around 0.2, it is possible to absorb a sensitivity error and correct a delay amount.

Delay operation section 452 adjusts a delay amount using a threshold value set based on a method such as described above. More specifically, for example, delay operation section 452 increases a delay amount as long as level difference cmp_info is not less than 0.2. Then, when level difference cmp_info reaches 0.2, delay operation section 452 stops the delay amount increase. Consequently, the delay amount is fixed at a proper value. Then, a first directional picked-up sound signal and a second directional picked-up sound signal each having a cardioid directivity characteristic are output from first signal output section 421 and second signal output section 422, respectively.

Actual inter-terminal sound distance dist_aterm can be expressed by, for example, equation 9 below using delay amount $\tau_{opt}$ [sec] at the point of time of stoppage of the delay amount increase. In the equation, "c" represents sound speed [m/sec].

[9]

$$\text{dist_}a\text{term}=\tau_{opt}\cdot c \quad \text{(Equation 9)}$$

The description of a level difference and a predetermined value that serves as a basis therefor has been given thus far.

<Description of Operation of Sound Processing Apparatus 400>

Next, operation of sound processing apparatus 400 will be described.

Figure 14:
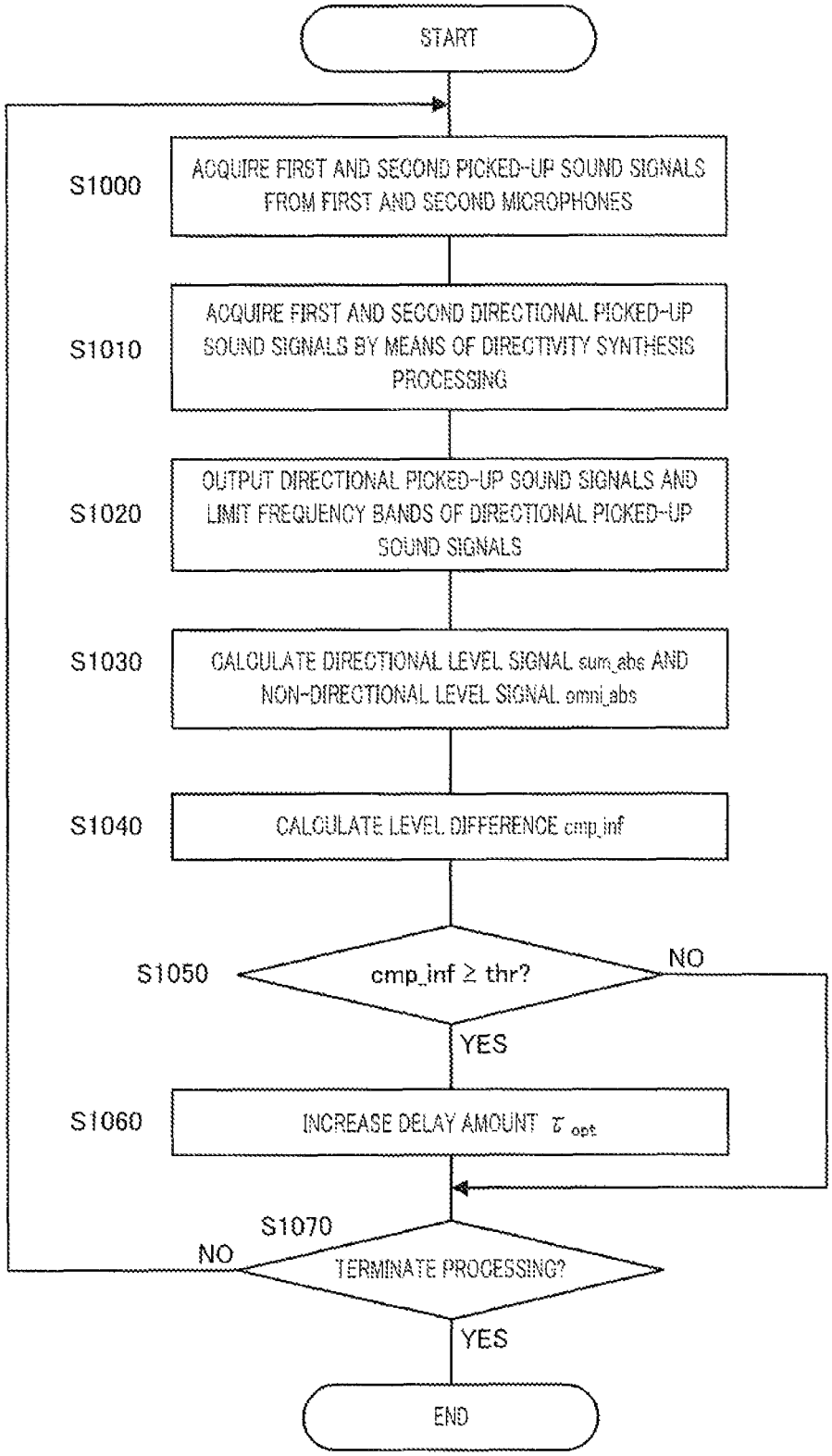
FIG. 14 is a flowchart illustrating an example of operation of a sound processing apparatus according to Embodiment 2 of the present invention.

FIG. 14 is a flowchart illustrating an example of operation of sound processing apparatus 400. Sound processing apparatus 400 starts, for example, the operation illustrated in FIG. 14 upon a power supply switch or a directional sound pickup function being turned on. Also, during the operation illustrated in FIG. 14 being performed, first microphone 200 and second microphone 300 continuously pick up sound.

First, in step S1000, directivity synthesis processing section 410 acquires a first picked-up sound signal and a second picked-up sound signal from first microphone 200 and second microphone 300, respectively.

Then, in step S1010, directivity synthesis processing section 410 acquires a first directional picked-up sound signal and a second directional picked-up sound signal by means of directivity synthesis processing.

Then, in step S1020, first signal output section 421 and second signal output section 422 output the first directional picked-up sound signal and the second directional picked-up sound signal, respectively, to the outside of sound processing apparatus 400. Also, first band limiting section 431 and second band limiting section 432 limit a frequency band of the first directional picked-up sound signal to be input to comparison signal calculation section 440 and a frequency band of the second directional picked-up sound signal to be input to comparison signal calculation section 440.

Then, in step S1030, comparison signal calculation section 440 calculates value sum_abs of a directional level signal and value omni_abs of a non-directional level signal.

Then, in step S1040, level comparison section 451 calculates level difference cmp_inf between value sum_abs of the directional level signal and value omni_abs of the non-directional level signal.

Then, in step S1050, delay operation section 452 determines whether or not level difference cmp_inf is equal to or exceeds predetermined threshold value thr.

If level difference cmp_inf is equal to or greater than predetermined threshold value thr (S1050: YES), delay operation section 452 proceeds to step S1060. If level difference cmp_inf is less than predetermined threshold value thr (S1050: NO), delay operation section 452 skips step S1060 and proceeds to step S1070 described later.

In step S1060, delay operation section 452 increases delay amount $\tau_{opt}$ to be used by directivity synthesis processing section 410 for directivity synthesis processing. An initial value of delay amount $\tau_{opt}$ is a sufficiently-small value. Also, an amount of the increase of delay amount $\tau_{opt}$ is a value set in relation to a period of time and processing load until delay amount $\tau_{opt}$ reaches a proper value and an accuracy required for a directivity pattern.

Then, in step S1070, directivity synthesis processing section 410 determines whether or not an instruction to terminate directivity synthesis processing has been provided via, e.g., a user operation. Such instruction is, for example, the input of a signal indicating that the power supply switch has been turned off or the directional sound pickup function has been turned off.

If no instruction to terminate directivity synthesis processing has been provided (S1070: NO), directivity synthesis processing section 410 returns to step S1000. Also, if an instruction to terminate directivity synthesis processing has been provided (S1070: YES), directivity synthesis processing section 410 ends a series of processing.

Such operation enables sound processing apparatus 400 to repeat directivity synthesis processing. Sound processing apparatus 400 thus can adjust a delay amount used for directivity synthesis processing so as to prevent occurrence of phase reversal in these signals, based on the first directional picked-up sound signal and the second directional picked-up sound signal. Then, finally, sound processing apparatus 400 performs directivity synthesis processing with the delay amount set to a proper value. Consequently, sound processing apparatus 400 can output a first directional picked-up sound signal and a second directional picked-up sound signal each having a directional characteristic close to a cardioid.

The description of operation of sound processing apparatus 400 has been given thus far.

As described above, sound pickup device 100 including sound processing apparatus 400 according to the present embodiment can adjust a delay amount to be used for directivity synthesis processing so as to prevent occurrence of phase reversal of directional picked-up sound signals each having directivity in an axial direction.

Consequently, sound pickup device 100 can easily set a delay amount to be used for directivity synthesis processing so as to provide a cardioid directivity characteristic as long as some kind of sound source exists in the axial direction.

Accordingly, as opposed to a case where PTL 1 described above is employed, sound pickup device 100 has no need for an acoustic design engineer to perform measurement in, e.g., an anechoic room each time a housing in which microphones are installed is changed and to adjust a delay amount for directivity synthesis processing.

Also, as opposed to a case where calculation is performed based on PTL 1 stated above, sound pickup device 100 calculates a proper value for a delay amount without using a conventional method such as correlation and thus can avoid malfunction even in an actual environment in which there are reflections and ambient noise.

Also, as opposed to a case where PTL 1 described above is employed, the sound source direction following capability of sound pickup device 100 does not deteriorate even in a situation in which an acoustic change occurs around the microphones or a plurality of sound sources exist at the same time.

In other words, compared to the conventional technique, sound pickup device 100 according to the present embodiment can perform correct delay amount adjustment in an actual environment even when an acoustic change occurs in, e.g., a structure and/or position in which microphones are mounted and structures around the microphones. Consequently, sound pickup device 100 according to the present embodiment can easily provide an arbitrary directivity pattern with good accuracy and can easily acquire wanted sound with high quality.

Also, if sound pickup devices 100 are mass-produced products, as described above, sound pickup devices 100 tend to have unstable directivity characteristics. Accordingly, the present invention is preferable for sound pickup devices 100 such as above.

The delay amount adjustment method is not limited to the above-described example.

For example, delay operation section 452 may continue the delay amount adjustment without fixing the delay amount even after level difference cmp_inf becomes less than the predetermined threshold value. In other words, delay operation section 452 may perform re-adjustment of the delay amount. More specifically, for example, if a minimum value of level difference cmp_inf is held and the held minimum value is updated within a fixed period of time, delay operation section 452 may monotonically reduce the delay amount.

Also, delay operation section 452 may limit the delay amount to a predetermined range to adjust the delay amount so as to prevent the delay amount from being largely varied by, e.g., the influence of components uncorrelated between microphones.

Embodiment 3

Embodiment 3 of the present invention is an embodiment in which there is added a function to the sound processing apparatus according to Embodiment 2 that prevents delay amount correction from being performed upon detection of components that are uncorrelated between a first picked-up sound signal and a second picked-up sound signal (hereinafter referred to as "uncorrelated components"). Here, circuit noise is not correlated between a first picked-up sound signal and a second picked-up sound signal, but always exists and thus is distinguished from uncorrelated components.

<Influences of Uncorrelated Components>

First, the causes of uncorrelated components and influence of uncorrelated components on delay amount adjustment will be described.

A vibration source that vibrates diaphragms of microphones may not be a sound wave but may be, e.g., mechanical vibration during zooming or wind pressure provided by wind at the time of photographing, e.g., outdoors in the case of, for example, a digital still camera or the like that can perform a zoom operation during recording.

Mechanical vibration directly vibrates diaphragms of microphones through transmission paths that are different from each other in a complicated manner in the housing. Thus, vibrations that have passed the different paths drive the respective microphones and appear on picked-up sound signals from the two microphones as uncorrelated components.

Wind causes disturbance of air currents having different characteristics around the microphones. Thus, vibrations due to wind also appear on picked-up sound signals from the two microphones as uncorrelated components.

If directivity synthesis processing is performed with such uncorrelated components contained in a first picked-up sound signal and a second picked-up sound signal, the uncorrelated components largely disturb a polar pattern that should be obtained by sound wave. Thus, if the delay amount adjustment described in Embodiment 2 is performed although a large number of uncorrelated components are included, an erroneous value can be set, or it may take time until a proper value is reached.

Therefore, a sound processing apparatus according to the present embodiment is configured to prevent delay amount adjustment based on directional picked-up sound signals from being performed where a large number of uncorrelated components are included.

<Configuration of Sound Pickup Device According to Embodiment 3>

Figure 15:
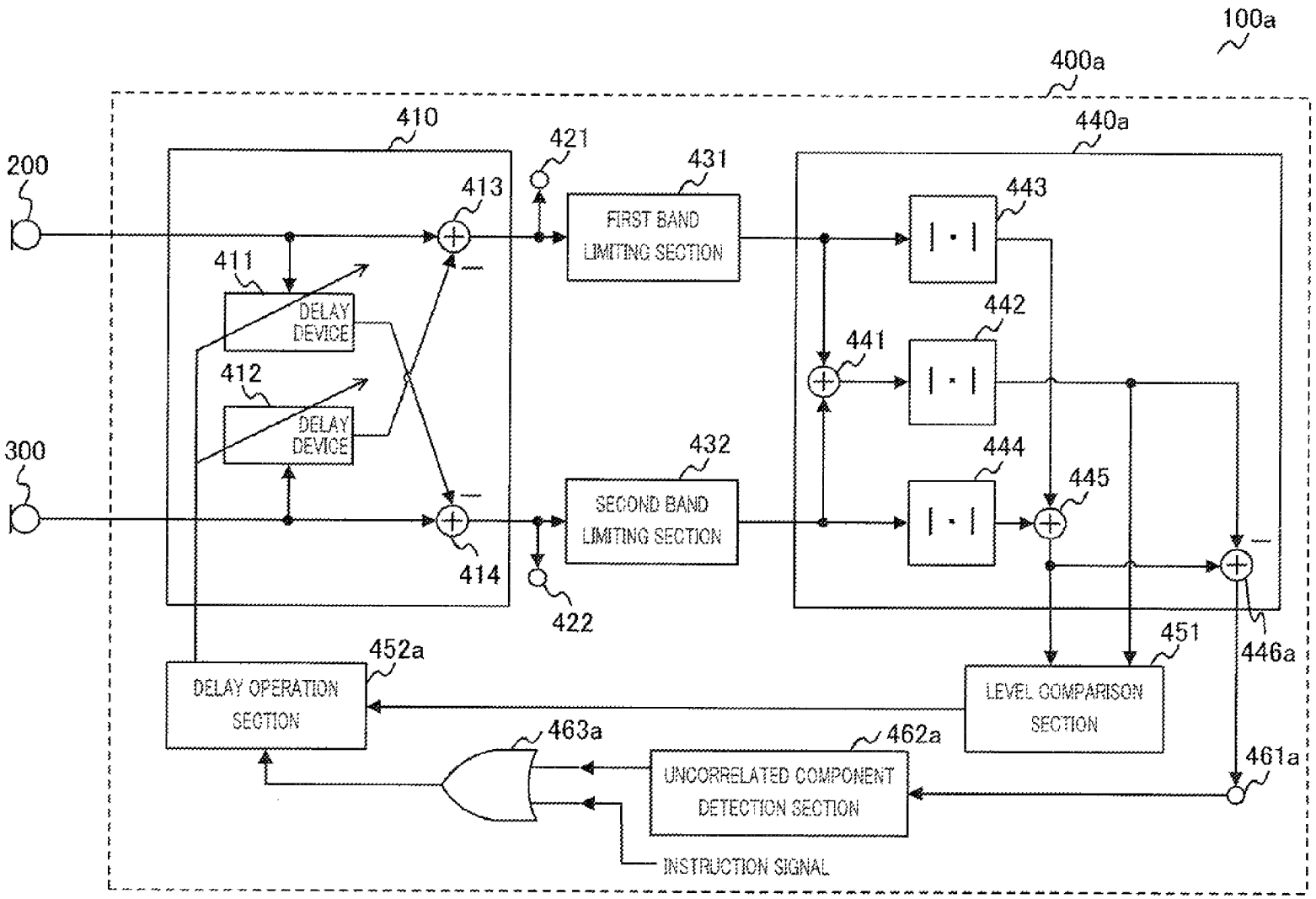
FIG. 15 is a block diagram illustrating a configuration example of a sound pickup device including a sound processing apparatus according to Embodiment 3 of the present invention.

FIG. 15 is a block diagram illustrating a configuration example of a sound pickup device including a sound processing apparatus according to Embodiment 3, and corresponds to FIG. 2 for Embodiment 2. Parts that are the same as those in FIG. 2 are provided with reference numerals that are the same as those in FIG. 2, and description thereof will be omitted.

In FIG. 15, sound processing apparatus 400*a* in sound pickup device 100*a* includes comparison signal calculation section 440*a* and delay operation section 452*a* instead of comparison signal calculation section 440 and delay operation section 452 illustrated in FIG. 2. Also, sound processing apparatus 400*a* further includes uncorrelation level signal output section 461*a*, uncorrelated component detection section 462*a* and OR circuit 463*a*.

Comparison signal calculation section 440*a* outputs a value obtained by subtracting a non-directional level signal from a directional level signal, as an uncorrelation level signal indicating a level of uncorrelated components. More specifically, comparison signal calculation section 440*a* includes fifth adder 446*a* in addition to the configuration described in Embodiment 2.

Fifth adder 446*a* adds up a directional level signal and a non-directional level signal with their polarity reversed and outputs an uncorrelation level signal, which is a result of the addition.

Here, the principle of uncorrelation level signal extraction will be described.

A band-limited first directional picked-up sound signal from first band limiting section 431 and a band-limited second directional picked-up sound signal from second band limiting section 432 contain vibration components that are uncorrelated between the signals upon application of, e.g., mechanical vibration to the device.

These signals are added up in terms of signal waveforms containing phase information without modification are and converted into level information, whereby a non-directional level signal having a property of strengthening correlated sound wave components while weakening uncorrelated vibration components is obtained because of the nature of synchronous addition.

On the other hand, the first directional picked-up sound signal and the second directional picked-up sound signal are respectively converted into pieces of information only including an amplitude with no phase information and the pieces of information are added up, whereby a directional level signal in which both correlated sound wave components and uncorrelated vibration components are strengthened.

Although the correlated sound components are cancelled off by subtracting the aforementioned non-directional level signal from the directional level signal, the uncorrelated vibration components remain, and thus, the uncorrelation level signal can be extracted.

Uncorrelation level signal output section 461*a* receives as input the uncorrelation level signal from comparison signal calculation section 440*a* and outputs a determination result signal indicating whether or not uncorrelated components are contained.

Uncorrelated component detection section 462*a* determines whether or not uncorrelated components are included between the first picked-up sound signal and the second picked-up sound signal. More specifically, uncorrelated component detection section 462*a* receives as input the uncorrelation level signal from uncorrelation level signal output section 461*a*, and if the uncorrelation level signal exceeds a predetermined threshold value, determines that a large number of uncorrelated components are included.

Then, uncorrelated component detection section 462*a* sequentially outputs a determination result signal indicating a result of the determination to OR circuit 463*a*. Here, it is assumed that the determination result signal takes a value of 0 if it is determined that no uncorrelated component is included, and takes a value of 1 if it is determined that a large number of uncorrelated components are included.

OR circuit 463*a* receives as input the determination result signal output from uncorrelated component detection section 462*a* and an instruction signal input from the outside of sound processing apparatus 400*a*. The instruction signal is a signal designating whether or not delay amount adjustment is performed. Here, it is assumed that the instruction signal takes a value of 0 if it is designated to perform delay amount adjustment, and takes a value of 1 if it is designated not to perform delay amount adjustment.

Then, OR circuit 463*a* takes the logical sum of the determination result signal and the instruction signal, and outputs the resulting signal as a control signal. In other words, the control signal takes a value of 0 if it is designated to perform delay amount adjustment and it is determined to contain no uncorrelated components, and takes a value of 1 in other cases.

The instruction signal is, for example, a signal generated via a user operation. Also, the instruction signal may be a detection signal from a sensor that detects wind noise. In this case, the instruction signal, for example, takes a value of 1 during wind noise being detected, and takes a value of 0 during no wind noise being detected.

Delay operation section 452*a* performs the delay amount adjustment described in Embodiment 2 if it is designated to perform delay amount adjustment and it is determined to include no uncorrelated components. In other words, delay operation section 452*a* receives as input the control signal from OR circuit 463*a*, and performs delay amount adjustment if the control signal exhibits 0. On the other hand, if the input control signal exhibits 1, delay operation section 452*a* does not perforin delay amount adjustment.

<Description of Operation of Sound Processing Apparatus According to Embodiment 3>

Figure 16:
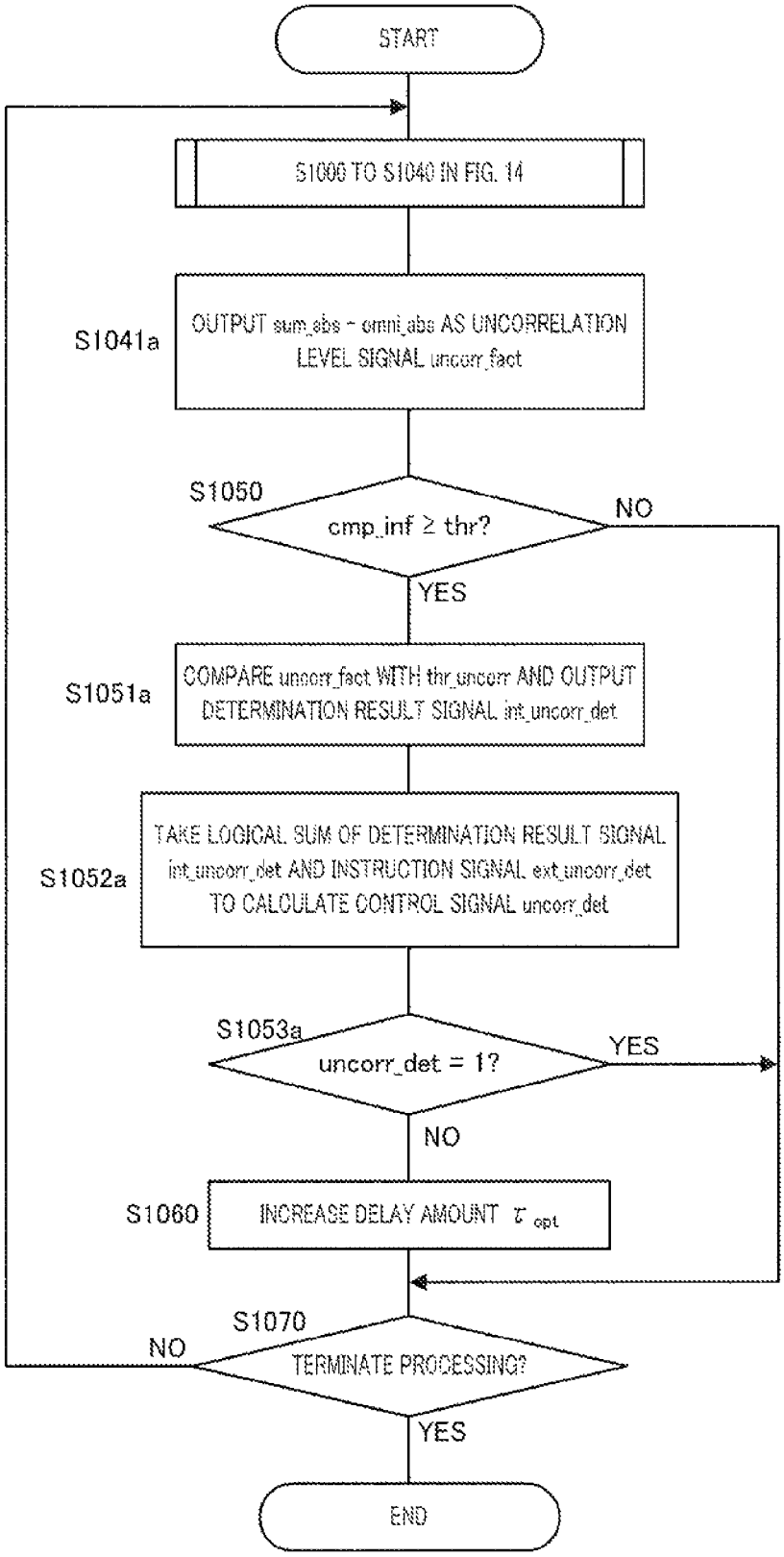
FIG. 16 is a flowchart illustrating an example of operation of the sound processing apparatus according to Embodiment 3 of the present invention.

FIG. 16 is a flowchart illustrating an example of operation of sound processing apparatus 400*a*, and corresponds to FIG. 14 for Embodiment 2. Parts that are the same as those in FIG. 14 are provided with step numbers that are the same as those in FIG. 14, and description thereof will be omitted.

Processing from steps S1000 to S1040 is similar to that in Embodiment 2.

After step S1040, in step S1041*a*, comparison signal calculation section 440*a* subtracts value omni_abs of a non-directional level signal from value sum_abs of a directional level signal. Then, comparison signal calculation section 440*a* outputs the resulting signal as an uncorrelation level signal (uncorr_fact). Here, step S1041*a* may be performed after step S1030.

Then, if level difference cmp_inf is equal to or greater than a predetermined threshold value thr (S1050: YES), delay operation section 452 proceeds to step S1051*a*.

Then, in step S1051*a*, uncorrelated component detection section 462*a* compares value uncorr_fact of the uncorrelation level signal with a predetermined threshold value thr_uncorr, and outputs determination result signal in_uncorr_det indicating a result of the comparison.

Then, in step S1052*a*, OR circuit 463*a* takes the logical sum of determination result signal in_uncorr_det and instruction signal ext_uncorr_det to calculate a control signal uncorr_det, which is a result of the logical sum operation.

Then, in step S1053*a*, delay operation section 452*a* determines whether or not a value of control signal uncorr_det is 1.

If the value of control signal uncorr_det is 0 (S1053*a*: NO), delay operation section 452*a* proceeds to step S1060. If the value of control signal uncorr_det is 1 (S1053*a*: YES), delay operation section 452*a* proceeds to step S1070.

As described above, sound processing apparatus 400*a* according to the present embodiment can determine whether or not a large number of uncorrelated components are included in picked-up sound signals, based on a difference between a directional level signal and a non-directional level signal. Then, sound processing apparatus 400*a* can prevent delay amount adjustment from being performed if a large number of uncorrelated components are included in the picked-up sound signals.

Consequently, even in an environment in which there is mechanical vibration or noise such as wind pressure, sound processing apparatus 400*a* can reduce the influence of such vibration or noise on delay amount adjustment, making it possible to easily providing an optional directivity pattern with good accuracy.

The uncorrelated component extraction method is not limited to the above-described example. For example, sound processing apparatus 400*a* may use an uncorrelated component extraction method described in PTL 2.

Also, the content of the uncorrelation level signal, which is an output from comparison signal calculation section 440*a*, has a meaning that is the same as that of equation 2 in Embodiment 2. Accordingly, level comparison section 451 may use the uncorrelation level signal instead of calculating level difference cmp_inf. Furthermore, the uncorrelation level signal may be input directly to delay operation section 452*a* as a level difference without providing level comparison section 451.

Embodiment 4

Embodiment 4 of the present invention is an example in which a voice signal with an optional directivity pattern is output using an adjusted delay amount.

<Configuration of Sound Processing Apparatus According to Embodiment 4>

Figure 17:
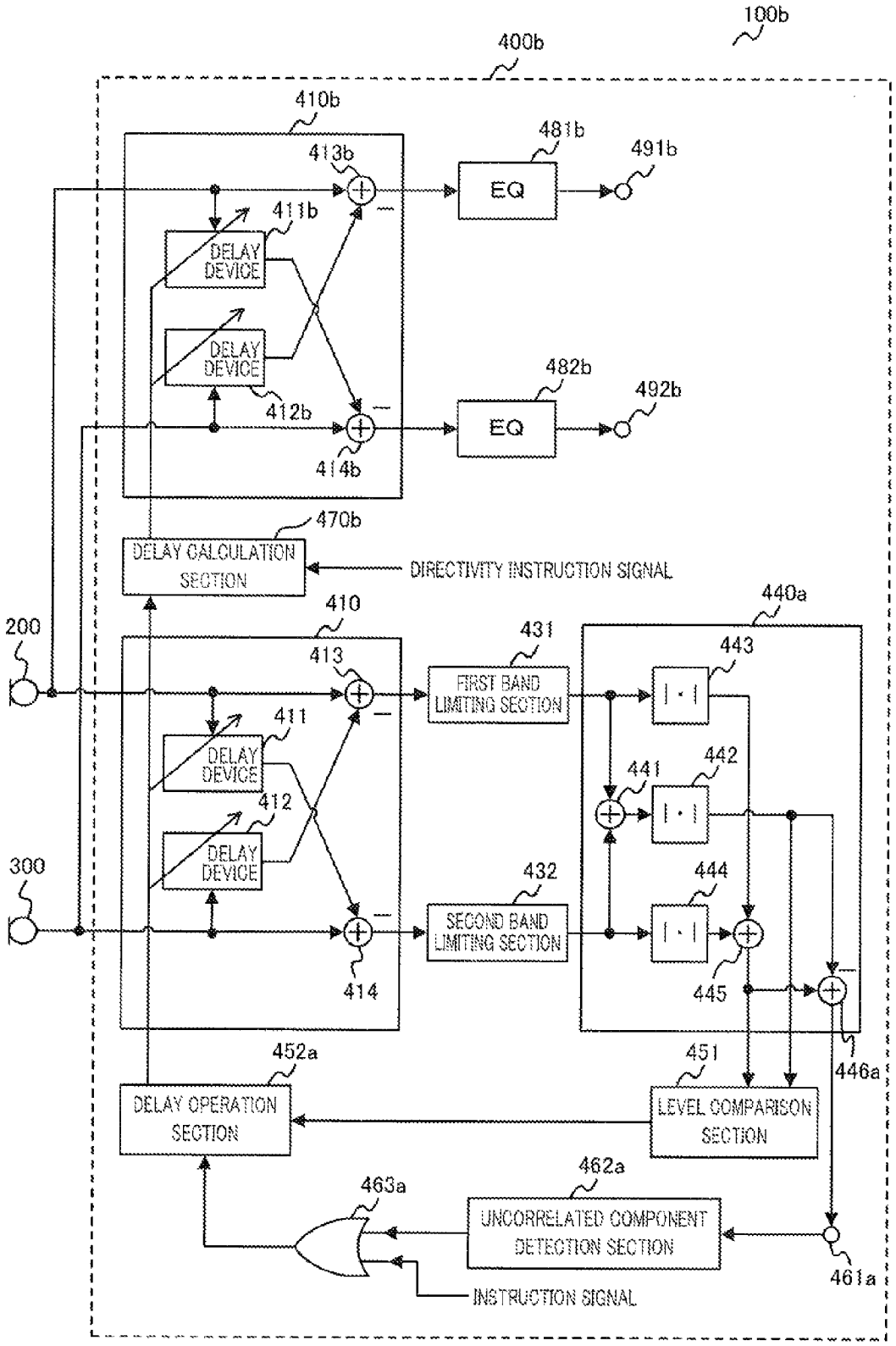
FIG. 17 is a block diagram illustrating a configuration example of a sound processing apparatus according to Embodiment 4 of the present invention.

FIG. 17 is a block diagram illustrating a configuration example of a sound processing apparatus according to Embodiment 4, and corresponds to FIG. 15 for Embodiment 3. Parts that are the same as those in FIG. 15 are provided with reference numerals that are the same as those in FIG. 15 and description thereof will be omitted.

In FIG. 17, sound processing apparatus 400*b* in sound pickup device 100*b* has a configuration further including other functional sections in addition to the configuration illustrated in FIG. 2. Sound processing apparatus 400*b* includes delay calculation section 470*b*, output directivity synthesis processing section 410*b*, first equalizer (EQ) 481*b*, second equalizer (EQ) 482*b*, first sound signal output section 491*b* and second sound signal output section 492*b*.

Delay calculation section 470*b* receives designation of a directivity and controls directivity synthesis processing in output directivity synthesis processing section 410*b*, which will be described later, based on an inter-terminal sound distance corresponding to a delay amount adjusted by delay operation section 452*a*. More specifically, delay calculation section 470*b* calculates the inter-terminal sound distance from the delay amount adjusted by delay operation section 452*a*, using, for example, equation 9 above. Then, delay calculation section 470*b* calculates an optimum delay amount based on a value of a directivity instruction signal input from the outside of sound processing apparatus 400*b* and the calculated inter-terminal sound distance, and outputs the optimum delay amount.

The directivity instruction signal is, for example, a signal generated via a user operation. Also, the instruction signal may be a detection signal from a sensor that detects a direction in which a person talking with the user is positioned.

Output directivity synthesis processing section 410*b* has, for example, a configuration that is the same as that of directivity synthesis processing section 410, and includes first delay device 411*b*, second delay device 412*b*, first adder 413*b* and second adder 414*b*, which correspond to first delay device 411, second delay device 412, first adder 413 and second adder 414 in Embodiment 2, respectively. In other words, first adder 413*b* outputs a first output directional picked-up sound signal, and second adder 414*b* outputs a second output directional picked-up sound signal.

Note that output directivity synthesis processing section 410*b* generates the first output directional picked-up sound signal and the second output directional picked-up sound signal, using the delay amount output from delay calculation section 470*b* (hereinafter referred to as "output delay amount").

First equalizer 481*b* receives as input the first output directional picked-up sound signal and corrects a frequency characteristic of the signal. Then, first equalizer 481*b* outputs a first equalized directional picked-up sound signal, which is a result of the correction.

Second equalizer 482*b* receives as input the second output directional picked-up sound signal and corrects a frequency characteristic of the signal. Then, second equalizer 482*b* outputs a second equalized directional picked-up sound signal, which is a result of the correction.

The frequency characteristic correction is a correction that, for example, where the inter-terminal sound distance is 10 mm, makes the first output directional picked-up sound signal and the second output directional picked-up sound signal have the respective frequency characteristics that are opposite to those illustrated in FIGS. 3 and 4. Such correction equalizes the frequency amplitude characteristics at 0 dB.

First sound signal output section 491*b* receives the first output directional picked-up sound signal as input. Then, first sound signal output section 491*b* outputs the first output directional picked-up sound signal to the outside of sound processing apparatus 400*b* for a sound output to the user.

Second sound signal output section 492*b* receives the second output directional picked-up sound signal as input. Then, second sound signal output section 492*b* outputs the second output directional picked-up sound signal to the outside of sound processing apparatus 400*b* for a sound output to the user.

In the present embodiment, first sound signal output section 491*b* and second sound signal output section 492*b* are disposed, eliminating the need for first signal output section 421 and second signal output section 422 in Embodiment 3; however, the present invention is not limited to this configuration.

<Method for Arithmetic Operation of Output Delay Amount to Obtain Optional Directivity Pattern>

Here, a method for arithmetic operation of an output delay amount in order to obtain an optional directivity pattern will be described.

Figure 18:
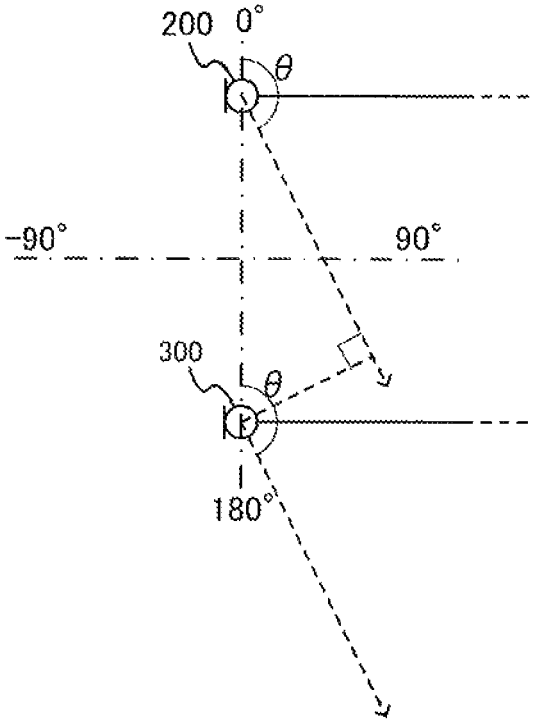
FIG. 18 is a diagram illustrating an example of a microphone-incident angle θ relationship for obtaining a designated directivity pattern, in Embodiment 4 of the present invention.

FIG. 18 is a diagram illustrating an example of a relationship between a microphone and incident angle θ for obtaining a designated directivity pattern.

In the present embodiment, it is assumed that a directivity pattern having a dead area in a direction of angle θ designated by a directivity designation signal is formed by means of a positional relationship such as illustrated in FIG. 18. In sound processing apparatus 400*b* according to the present embodiment, if a dead area is set in the angle θ direction, a dead area is also formed in an angle −θ direction, correspondingly.

In this case, delay calculation section 470*b* first calculates actual inter-terminal sound distance dist_aterm from delay amount $\tau_{opt}$ output from delay operation section 452*a*, using equation 9 above. Then, delay calculation section 470*b* calculates output delay amount $\tau_{act}$ from designated angle θ and calculated inter-terminal sound distance dist_aterm, using, for example, equation 10 below.

[10]

$$\tau_{act} = \frac{\text{dist_aterm} \cdot \cos(180 - \theta)}{c} \quad \text{(Equation 10)}$$

As described above, sound processing apparatus 400*b* can output a sound signal having a correct directivity pattern having a dead area in the angle θ direction (and the −θ direction), using output delay amount $\tau_{act}$, which has been calculated from actual inter-terminal sound distance dist_aterm.

<Description of Operation of Sound Processing Apparatus According to Embodiment 4>

Figure 19:
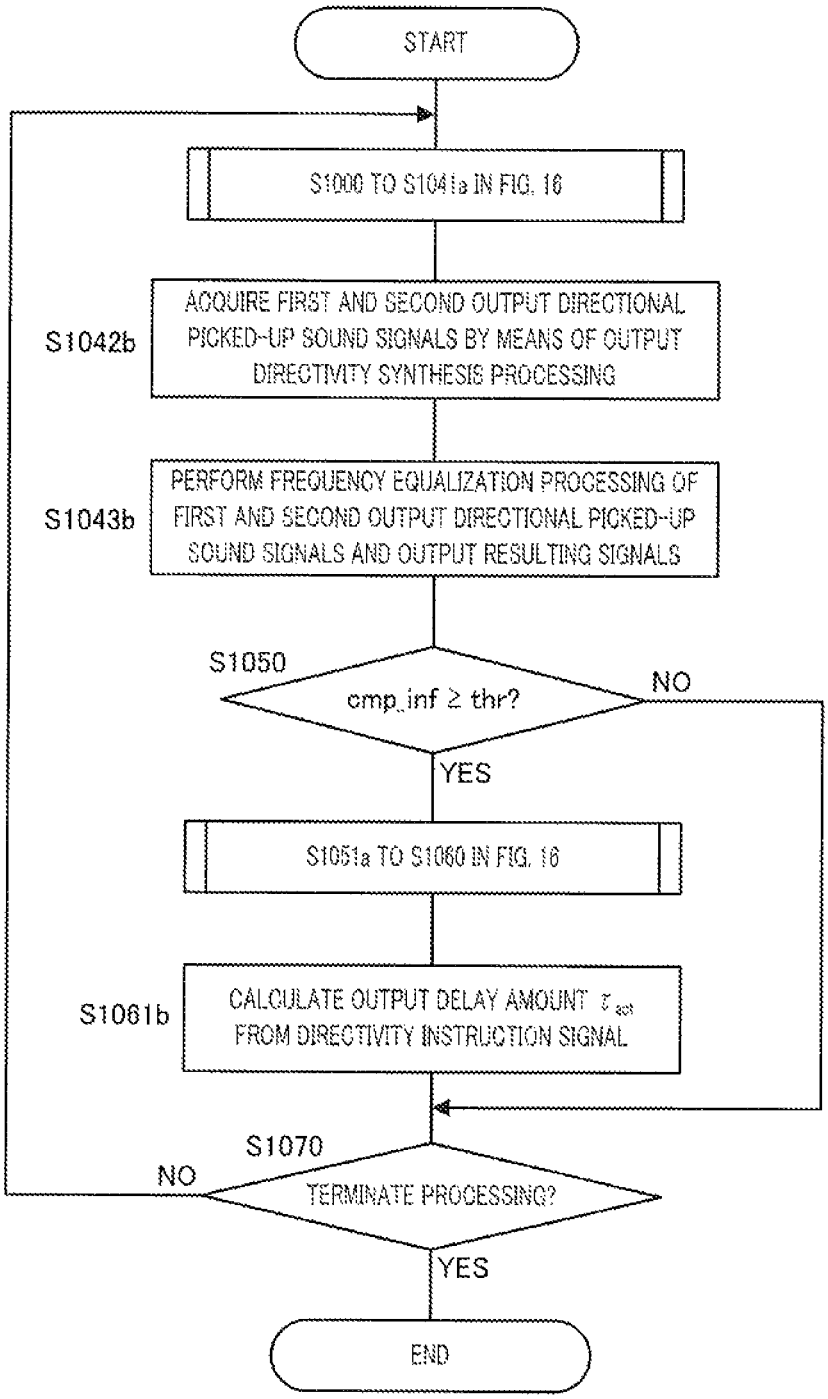
FIG. 19 is a flowchart illustrating an operation example of the sound processing apparatus according to Embodiment 4 of the present invention.

FIG. 19 is a flowchart illustrating an operation example of sound processing apparatus 400*b*, and corresponds to FIG. 16 for Embodiment 3. Parts that are the same as those in FIG. 16 are provided with step numbers that are the same as those in FIG. 16, and description thereof will be omitted.

Processing in steps S1000 to S1041*a* is similar to that of Embodiment 3.

After step S1041*a*, in step S1042*b*, output directivity synthesis processing section 410*b* acquires a first output directional picked-up sound signal and a second output directional picked-up sound signal by means of output directivity synthesis processing.

Then, in step S1043*b*, first equalizer 481*b* and second equalizer 482*b* perform frequency equalization processing of the first output directional picked-up sound signal and the second output directional picked-up sound signal, respectively. Then, first sound signal output section 491*b* and second sound signal output section 492*b* output the first output directional picked-up sound signal and the second output directional picked-up sound signal, which have been subjected to the frequency equalization processing.

The timing for performing the processing in steps S1042*b* and S1043*b* is not limited to the aforementioned timing.

Then, in step S1050, delay operation section 452*a* determines whether level difference cmp_inf is equal to or greater than predetermined threshold value thr and a value of control signal uncorr_det is 1.

If level difference cmp_inf is equal to or greater than predetermined threshold value thr and the value of control signal uncorr_det is 1 (S1050: YES and S1053*a*: YES), delay operation section 452*a* proceeds to step S1061*b* through steps S1051*a* to 1060.

In step S1061*b*, delay calculation section 470*b* calculates output delay amount $\tau_{act}$ from a directivity instruction signal, sets output delay amount $\tau_{act}$ in output directivity synthesis processing section 410*b* and proceeds to step S1070.

As described above, sound processing apparatus 400*b* according to the present embodiment can accurately provide an optional directivity pattern from a delay amount corresponding to an actual inter-terminal sound distance calculated according to each acoustic change around the microphones. Consequently, sound processing apparatus 400*b* can accurately adjust a delay amount in an actual environment even when an acoustic change occurs in, e.g., a structure and/or a position in which the microphones are mounted and structures around the microphones. Consequently, sound processing apparatus 400*b* can easily perform directional sound pickup having an optional directivity pattern with good accuracy, enabling acquisition of required sound with high quality.

Although in the present embodiment, output directivity synthesis processing forms a dead area by means of subtraction, output directivity synthesis processing according to the present invention is not limited to this case. Output directivity synthesis processing may be addition-type (Delay_And_Sum) processing. In this case, since an actual inter-terminal sound distance has been obtained, a desired directivity characteristic can be obtained with good accuracy.

Also, in Embodiments 1 to 4 described above, a delay amount for a first picked-up sound signal and a delay amount for a second picked-up sound signal are adjusted and set to a same value. However, two microphones may have substantially-different sound paths because of a difference between ambient environments in which the respective microphones are installed. In such case, a delay amount for a first picked-up sound signal and a delay amount for a second picked-up sound signal may be adjusted and set to different values.

Also, although two microphones have been provided in the above embodiments, the present invention is not limited to this configuration. The delay amount correction according to the present invention is performed for each pair of two microphones, and thus, if there are three or more microphones, a delay amount correction may be performed for each of pairs of the microphones. Accordingly, the present invention is applicable also to a case where directivity synthesis processing is performed for picked-up sound signals output from three or more microphones.

Also, the sound to be output to a user may be a first directional picked-up sound signal and a second directional picked-up sound signal output from directivity synthesis processing section 410. Note that, in this case, a level of a low-frequency band is insufficient compared to a level of a high frequency band in view of the frequency characteristic perspective (see FIGS. 3 and 4). Thus, in the present embodiment, it is desirable to add components corresponding to first equalizer 481*b* and second equalizer 482*b* to perform a correction so as to amplify a low-frequency band or attenuate a high-frequency band.

Embodiment 5

Embodiment 5 of the present invention is an example of a specific mode where the present invention has been applied to a sound pickup device including four microphones in, e.g., a remote conference system.

In the present embodiment, the sound pickup device is one that delays and sums (delay-and-sum) picked-up sound signals from the four microphones to perform directional sound pickup for a speaker in a designated direction.

Figure 20:
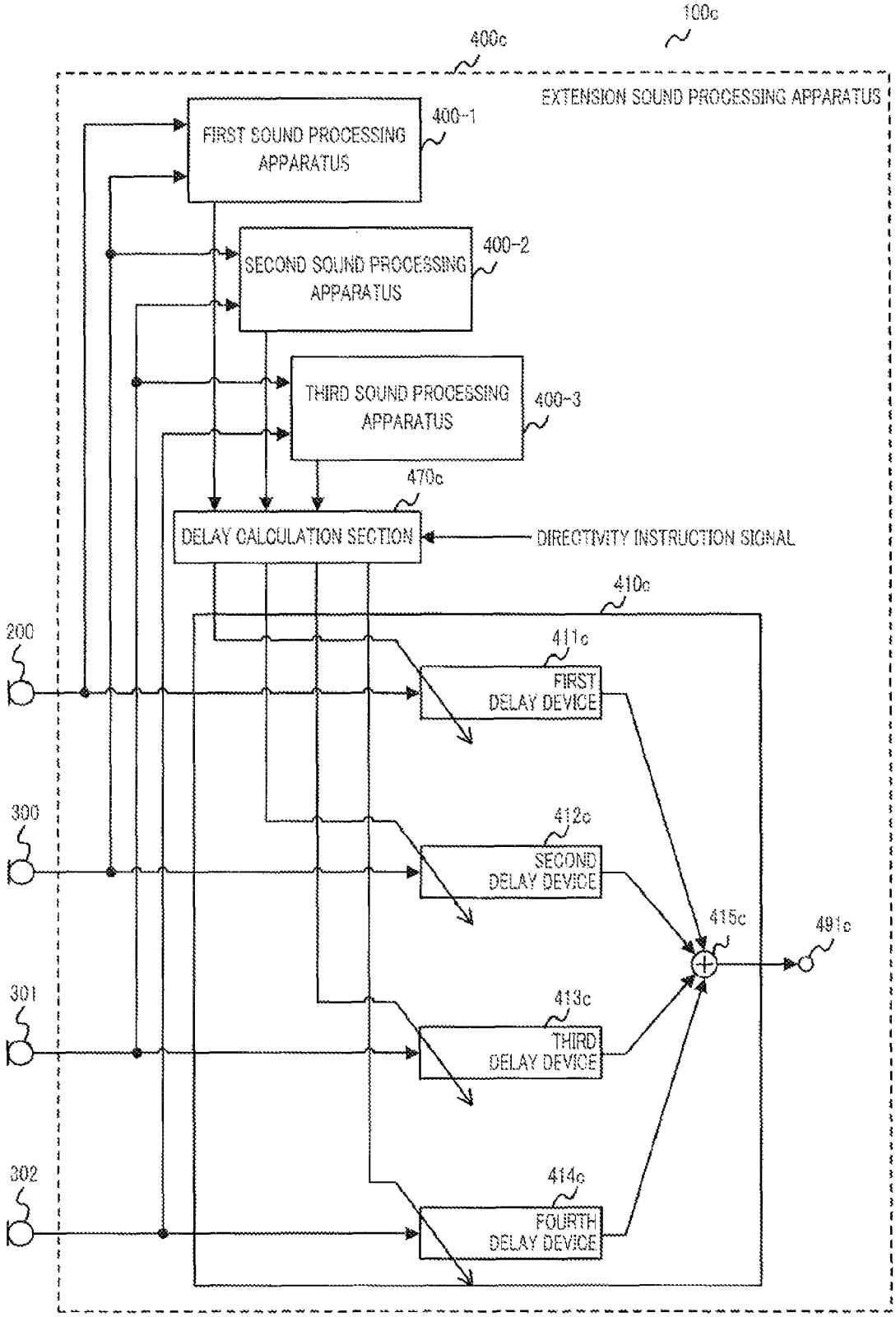
FIG. 20 is a block diagram illustrating a configuration example of a sound processing apparatus according to Embodiment 5 of the present invention.

FIG. 20 is a block diagram illustrating an example of a processing configuration of a microphone array according to the present embodiment, and corresponds to FIG. 2 for Embodiment 2. Parts that are the same as those in FIG. 2 are provided with reference numerals that are the same as those in FIG. 2, and description thereof will be omitted. Also, if there are a plurality of parts having a same configuration, such parts are provided with same reference numerals with a hyphen and respective serial numbers affixed thereto like [−1, −2, . . . ].

<Configuration of Sound Pickup Device>

First, a configuration of a sound pickup device including a sound processing apparatus according to the present embodiment will be described.

In FIG. 20, sound pickup device 100*c* includes third microphone 301 and fourth microphone 302 in addition to extension sound processing apparatus 400*c* and first microphone 200 and second microphone 300 illustrated in FIG. 2.

First microphone 200, second microphone 300, third microphone 301 and fourth microphone 302 are disposed at different positions away from one another. Here, for simplicity, it is assumed that the respective microphones are aligned in a straight line. Also, first microphone 200, second microphone 300, third microphone 301, fourth microphone 302 and extension sound processing apparatus 400*c* are disposed, for example, inside a housing (not illustrated) of sound pickup device 100*c*.

Third microphone 301 is a non-directional microphone (third sound pickup unit). Third microphone 301 picks up sound and outputs a picked-up sound signal. Hereinafter, a picked-up sound signal output by third microphone 301 is referred to as "third picked-up sound signal."

Fourth microphone 302 is a non-directional microphone (fourth sound pickup unit). Fourth microphone 302 picks up sound and outputs a picked-up sound signal. Hereinafter, a picked-up sound signal output by fourth microphone 302 is referred to as "fourth picked-up sound signal."

Extension sound processing apparatus 400*c* receives as input a first picked-up sound signal, a second picked-up sound signal, a third picked-up sound signal and a fourth picked-up sound signal. Then, extension sound processing apparatus 400*c* performs directional sound pickup in a direction designated by a directivity instruction signal, which is a signal externally input to extension sound processing apparatus 400*c*.

More specifically, as illustrated in FIG. 2, extension sound processing apparatus 400*c* includes first to third sound processing apparatuses (400-1, 400-2 and 400-3), delay calculation section 470*c*, output directivity synthesis processing section 410*c* and sound signal output section 491*c*.

First sound processing apparatus 400-1 receives the inputs of the first picked-up sound signal and the second picked-up sound signal. Then, first sound processing apparatus 400-1 calculates a delay amount (hereinafter referred to as "first delay amount") corresponding to an inter-terminal sound distance between first microphone 200 and second microphone 300 (hereinafter referred to as "first inter-terminal sound distance"). Then, first sound processing apparatus 400-1 outputs the calculated first delay amount to delay calculation section 470*c*.

Second sound processing apparatus 400-2 receives the second picked-up sound signal and the third picked-up sound signal as input. Then, second sound processing apparatus 400-2 calculates a delay amount (hereinafter referred to as "second delay amount") corresponding to an inter-terminal sound distance between second microphone 300 and third microphone 301 (hereinafter referred to as "second inter-terminal sound distance"). Then, second sound processing apparatus 400-2 outputs the calculated second delay amount to delay calculation section 470*c*.

Third sound processing apparatus 400-3 receives the third picked-up sound signal and the fourth picked-up sound signal as input. Then, third sound processing apparatus 400-3 calculates a delay amount (hereinafter referred to as "third delay amount") corresponding to an inter-terminal sound distance between third microphone 301 and fourth microphone 302 (hereinafter referred to as "third inter-terminal sound distance"). Then, third sound processing apparatus 400-3 outputs the calculated third delay amount to delay calculation section 470*c*.

Delay calculation section 470*c* multiplies each of the first to third delay amounts output from first to third sound processing apparatuses 400-1 to 400-3, respectively, by the speed of sound to calculate the first to third inter-terminal sound distances. Delay calculation section 470*c* calculates the respective delay amounts for first to fourth delay devices 411*c* to 414*c* in output directivity synthesis processing section 410*c*, based on angle θ of the sound pickup direction designated by the directivity instruction signal and the calculated first to third inter-terminal sound distances. Then, delay calculation section 470*c* outputs a first output delay amount to first delay device 411*c* and a second output delay amount to second delay device 412*c*. Also, delay calculation section 470*c* outputs a third output delay amount to third delay device 413*c* and outputs a fourth output delay amount to fourth delay device 414*c*.

The directivity instruction signal is a signal generated by, for example, a user operation and is a signal indicating an operation angle for performing directivity synthesis. In a conference system, such operation angle is, for example, an angle between a front direction of a sound processing apparatus in the conference system and a direction toward a position of a speaker. Also, a sound pickup direction designated by a directivity instruction signal may be one automatically calculated. For example, a direction designated by a directivity instruction signal may be a direction of a talker, which is automatically identified based on a detection signal from a sensor that detects a direction of a speaker.

Sound signal output section 491*c* receives as input an output directivity-synthesized signal, which is output from output directivity synthesis processing section 410, and outputs the output directivity-synthesized signal to the outside of extension sound processing apparatus 400*c* as a sound output to the user. More specifically, the output directivity-synthesized signal is output as a voice signal input by sound pickup device 100*c* (here, the conference system body (not illustrated)).

Output directivity synthesis processing section 410*c* includes first delay device 411*c*, second delay device 412*c*, third delay device 413*c*, fourth delay device 414*c* and adder 415*c*.

First delay device 411*c* performs an operation to delay the first picked-up sound signal output from first microphone 200 based on the first output delay amount, which has been output from delay calculation section 470*c*. Then, first delay device 411*c* outputs a first delayed picked-up sound signal resulting from the first picked-up sound signal being delayed by the first output delay amount, to adder 415*c*.

Second delay device 412*c* performs an operation to delay the second picked-up sound signal output from second microphone 300 based on the second output delay amount, which has been output from delay calculation section 470*c*. Then, second delay device 412*c* outputs a second delayed picked-up sound signal resulting from the second picked-up sound signal being delayed by the second output delay amount, to adder 415*c*.

Third delay device 413*c* performs an operation to delay the third picked-up sound signal output from third microphone 301 based on the third output delay amount, which has been output from delay calculation section 470*c*. Then, third delay device 413*c* outputs a third delayed picked-up sound signal resulting from the third picked-up sound signal being delayed by the third output delay amount, to adder 415*c*.

Fourth delay device 414*c* performs an operation to delay the fourth picked-up sound signal output from fourth microphone 302 based on the fourth output delay amount, which has been output from delay calculation section 470*c*. Then, fourth delay device 414*c* outputs a fourth delayed picked-up sound signal resulting from the fourth picked-up sound signal being delayed by the fourth output delay amount, to adder 415*c*.

Adder 415*c* generates an output directivity-synthesized signal by adding up the first delayed picked-up sound signal, the second delayed picked-up sound signal, the third delayed picked-up sound signal and the fourth delayed picked-up sound signal and outputs the output directivity-synthesized signal to sound signal output section 491*c*.

<Method for Arithmetic Operation to Obtain Output Delay Amounts for Provision of Optional Directivity Pattern>

Here, a method for calculating first to fourth output delay amounts to perform directivity synthesis processing for any direction in directivity synthesis processing section 410*c* will be described.

Figure 21:
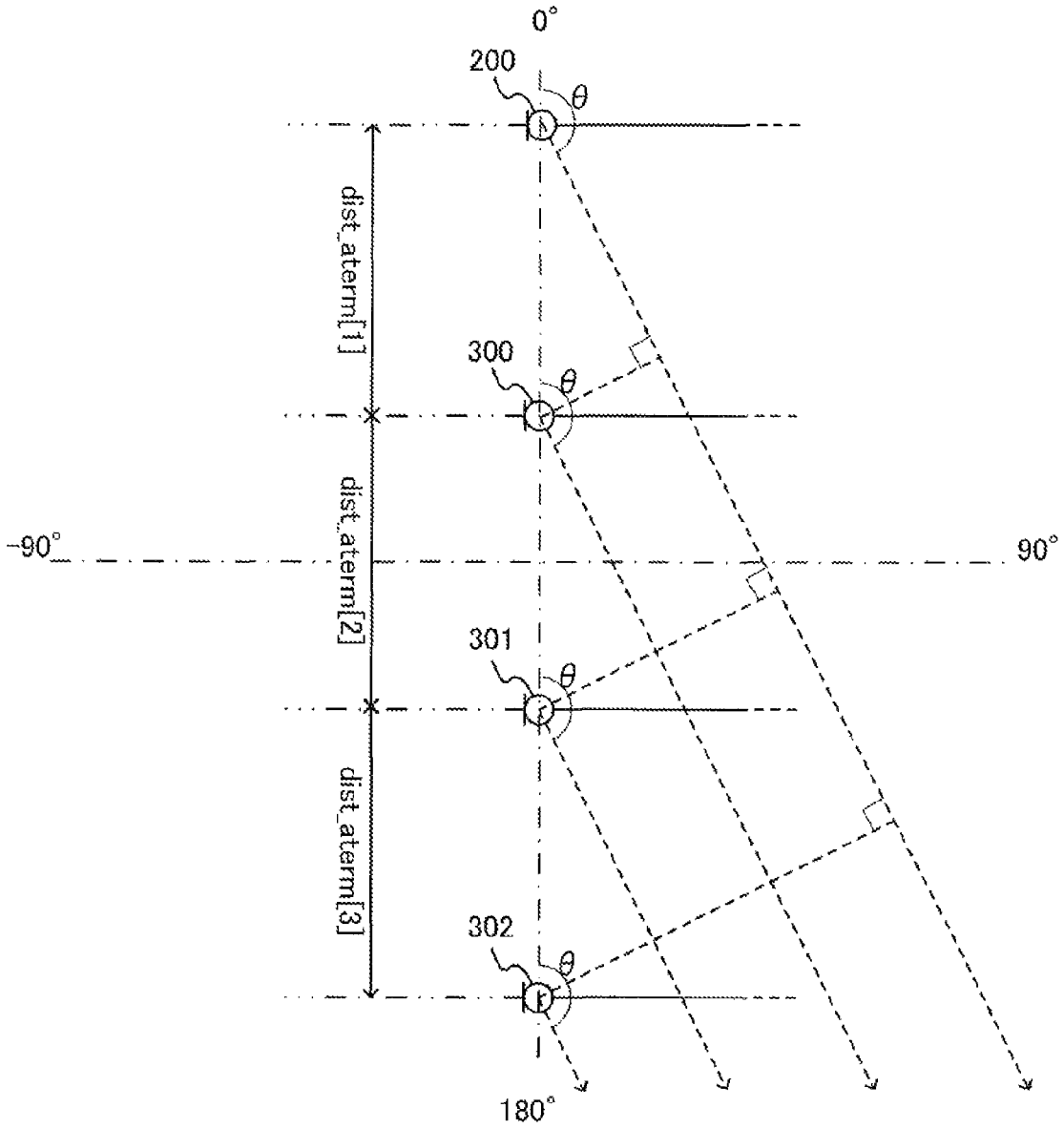
FIG. 21 is a diagram illustrating an example of a microphone-designated direction angle θ relationship for providing a designated directivity pattern in Embodiment 5 of the present invention.

FIG. 21 is a diagram illustrating an example of a relationship between a microphone and designated direction angle θ for providing a designated directivity pattern.

In the present embodiment, it is assumed that a directivity pattern having a directivity angle in a direction of angle θ designated by a directivity instruction signal is formed in a positional relationship as illustrated in FIG. 21. Upon a directivity angle being set in the angle θ direction, extension sound processing apparatus 400*c* according to the present embodiment also forms a directivity angle in a direction of −180+θ accordingly.

In this case, delay calculation section 470*c* calculates i-th inter-terminal sound distance dist_aterm [i] (i={1, 2, 3}) using, for example, equation 11 below. Here, $\tau_{opt}$ [i] is an i-th delay amount described above.

[11]

$$\text{dist_aterm}[i]=\tau_{opt}[i]\cdot c \qquad \text{(Equation 11)}$$

Then, if designated angle θ is 0°≤θ≤90° or −90°≥θ≥−180°, delay calculation section 470*c* calculates i-th output delay amount $\tau_{act}$ [i] using, for example, equation 12 below.

[12]

$$\tau_{act}[i] = \frac{\sum_{j=1}^{4-i} \text{dist_aterm}[4-j]\cdot\cos\theta}{c} \qquad \text{(Equation 12)}$$

Note that delay calculation section 470*c* calculates fourth output delay amount $\tau_{act}$ [4] using, for example, equation 13 below.

[13]

$$\tau_{act}[4]=0 \qquad \text{(Equation 13)}$$

Also, if designated angle θ is 90°≤θ≤180° or 0°≥θ≥−90°, delay calculation section 470*c* calculates i-th output delay amount $\tau_{act}$ [i] using, for example, equation 14 below.

[14]

$$\tau_{act}[i] = \frac{\sum_{j=1}^{i-1} \text{dist_aterm}[j]\cdot\cos(180-\theta)}{c} \qquad \text{(Equation 14)}$$

Note that delay calculation section 470*c* calculates fourth output delay amount $\tau_{act}$ [1] using, for example, equation 15 below.

[15]

$$\tau_{act}[1]=0 \qquad \text{(Equation 15)}$$

As described above, extension sound processing apparatus 400*c* calculates an actual inter-terminal sound distance for each of microphone pairs and provides an output delay amount to each delay device. Consequently, extension sound processing apparatus 400*c* can output a sound signal having a directivity pattern correctly having a directivity angle in a θ direction (and a −180+θ direction).

<Description of Operation of Sound Processing Apparatus According to Embodiment 5>

Figure 22:
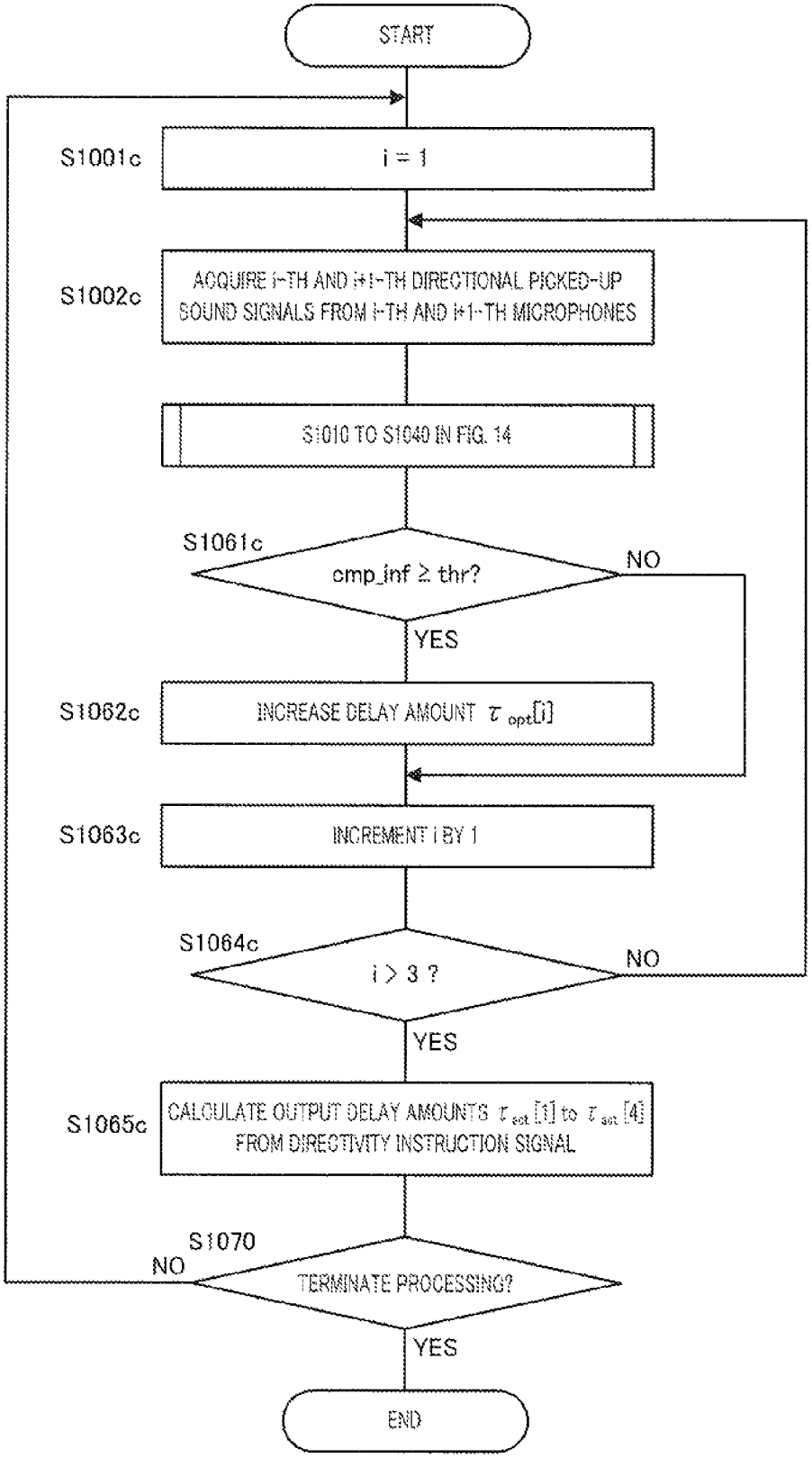
FIG. 22 is a flowchart illustrating an operation example of the sound processing apparatus according to Embodiment 5 of the present invention.

FIG. 22 is a flowchart illustrating an operation example of extension sound processing apparatus 400*c*, and corresponds to FIG. 14 for Embodiment 2. Parts that are the same as those in FIG. 14 are provided with step numbers that are the same as those in FIG. 14, and description thereof will be omitted.

Since the present embodiment has a configuration including four microphones, there are three pairs of microphones adjacent to one another. Thus, extension sound processing apparatus 400*c* executes the loop of processing similar to that in FIG. 14 three times. Thus, in the present embodiment, for convenience, "i" used in the above description is used as an index of the loop count.

After the start of processing, first, in step S1001*c*, delay calculation section 470*c* initializes index "i" to 1.

Then, in step S1002*c*, directivity synthesis processing section 410-*i* (not illustrated) in i-th sound processing apparatus 400-*i* performs directivity synthesis processing. Likewise, directivity synthesis processing section 410-(*i*+1) in i+1-th sound processing apparatus 400-(*i*+1) (not illustrated) performs directivity synthesis processing. Consequently, extension sound processing apparatus 400*c* acquires an i-th directional picked-up sound signal and an i+1-th directional picked-up sound signal.

Processing from steps S1010 to S1040 is similar to that in Embodiment 2 and is performed for each index "i."

Then, in step S1061*c*, delay operation section 452-*i* (not illustrated) in i-th sound processing apparatus 400-*i* determines whether or not level difference cmp_inf is equal to or greater than predetermined threshold value thr.

If level difference cmp_inf is equal to or greater than predetermined threshold value thr (S1061*c*: YES), delay operation section 452 proceeds to step S1062*c*. Also, if level difference cmp_inf is less than predetermined threshold value thr (S1061*c*: NO), delay operation section 452 skips step S1062*c* and proceeds to step S1063*c* described later.

In step S1062*c*, for each index "i," delay operation section 452-*i* (not illustrated) in i-th sound processing apparatus 400-*i* increases i-th delay amount $\tau_{opt}$ [i] to be used by directivity synthesis processing section 410-*i* (not illustrated). An initial value of i-th delay amount $\tau_{opt}$ [1] is a sufficiently-small value. Also, an amount of the increase of i-th delay amount $\tau_{opt}$ [1] is a value set in relation to a period of time and processing load until i-th delay amount $\tau_{opt}$ [i] converges to a proper value and an accuracy required for a directivity pattern.

Then, in step S1063*c*, in order to perform processing for a next microphone pair, delay calculation section 470*c* increments index "i" of the loop count by one.

Then, in step S1064*c*, delay calculation section 470*c* checks whether or not index "i" exceeds a predetermined count, that is, the loop is repeated a predetermined number of times. In the present embodiment, since four microphones are provided and there are three pairs of microphones adjacent to one another, an upper limit value of index "i" is 3. Accordingly, delay calculation section 470*c* determines whether or not index "i" is larger than 3.

If index "i" is equal to or less than 3 (S1064*c*: NO), delay calculation section 470*c* returns to step S1002*c*. Also, if index "i" is greater than 3 (S1064*c*: YES), delay calculation section 470*c* proceeds to step S1064*c*.

In step S1065*c*, delay calculation section 470*c* calculates output delay amounts using a directivity instruction signal indicating an externally-designated directivity angle and first delay amount $\tau_{opt}$ [1], second delay amount $\tau_{opt}$ [2] and third delay amount $\tau_{opt}$ [3]. In other words, delay calculation section 470*c* calculate first to fourth output delay amounts $\tau_{act}$ [1], $\tau_{act}$ [2] $\tau_{act}$ [3] and $\tau_{act}$ [4], which are delay amounts to be used by first to fourth delay devices 411*c* to 414*c*, respectively. Then, directivity synthesis processing section 410*c* performs output directivity synthesis processing and thereby obtains an output directivity-synthesized signal and proceeds to step S1070.

As described above, extension sound processing apparatus 400*c* according to the present embodiment can accurately provide an optional directivity pattern from a delay amount corresponding to an actual inter-terminal sound distance calculated according to each actual acoustic change around the microphones. Consequently, even when an acoustic change occurs in, e.g., a structure and/or a position in which the microphones are mounted and structures around the microphones, sound processing apparatus 400*b* can accurately adjust a delay amount in the actual environment. In other words, even in an actual environment, sound processing apparatus 400*b* can easily achieve highly-accurate directional pickup having an optional directivity pattern, enabling acquisition of required sound with high quality.

Although in the present embodiment, in output directivity synthesis processing, a directivity angle is formed by means of addition, the present invention is not limited to this embodiment. Output directivity synthesis processing may be sound pressure gradient-type processing using subtraction processing. In this case, also, an actual inter-terminal sound distance is obtained and thus a desired directivity characteristic with good accuracy can be obtained.

Also, although the microphone array of a straight-line shape is used in this embodiment for ease of description, the present invention is not limited to this configuration. Forming a microphone array in a square shape and obtaining an inter-terminal sound distance for each of pairs related to directivity synthesis also makes it possible to perform accurate directional sound pickup, likewise.

Also, although four microphones are provided in this embodiment, the number of microphones is not limited to four, and as long as at least two microphones which can form a pair are provided, any number of microphones can be provided.

The disclosure of the specification, the drawings and the abstract included in Japanese Patent Application No. 2011-278242 filed on Dec. 20, 2011 is incorporated herein by reference in its entirety.

INDUSTRIAL APPLICABILITY

The present invention makes it possible to provide an optional directivity pattern with good accuracy by accurately adjusting a delay amount in an actual environment even when an acoustic change occurs in, e.g., a structure and/or a position in which microphones are mounted and structures around the microphones. In other words, the present invention is useful for a sound processing apparatus and a sound processing method that enable easier acquisition of required sound with high quality. For example, the present invention is suitable for, e.g., digital still cameras having a video shooting function, digital video cameras, sound collectors, sound pickup devices in remote conference systems or various types of stereo recording apparatuses.

REFERENCE SIGNS LIST

100, 100*a*, 100*b* Sound pickup device
200 First microphone
300 Second microphone
301 Third microphone
302 Fourth microphone
400, 400*a*, 400*b* Sound processing apparatus
400-1 First sound processing apparatus
400-2 Second sound processing apparatus
400-3 Third sound processing apparatus
400*c* Extension sound processing apparatus
410 Directivity synthesis processing section
410*b* Output directivity synthesis processing section
411, 411*b*, 411*c* First delay device
412, 412*b*, 412*c* Second delay device

413*c* Third delay device
414*c* Fourth delay device
413, 413*b* First adder
414, 414*b* Second adder
415*c* Adder
421 First signal output section
422 Second signal output section
431 First band limiting section
432 Second band limiting section
440, 440*a* Comparison signal calculation section
441 Third adder
442 First level signal calculation section
443 Second level signal calculation section
444 Third level signal calculation section
445 Fourth adder
446*a* Fifth adder
451 Level comparison section
452, 452*a* Delay operation section
461*a* Uncorrelation level signal output section
462*a* Uncorrelated component detection section
463*a* OR circuit
470*b*, 470*c* Delay calculation section
481*b* First equalizer
482*b* Second equalizer
491*b* First sound signal output section
491*c* Sound signal output section
492*b* Second sound signal output section

The invention claimed is:

1. A sound processing apparatus that performs, for each of sound pickup unit pairs extracted from three or more sound pickup units, directivity synthesis processing of a first picked-up sound signal output from a first sound pickup unit comprising the sound pickup unit pair and a second picked-up sound signal output from a second sound pickup unit comprising the sound pickup unit pair, the apparatus comprising:

a directivity synthesis processing section that generates, for each of the sound pickup unit pairs, a first directional picked-up sound signal by delaying the second picked-up sound signal relative to the first picked-up sound signal and combining the first picked-up sound signal with the delayed second picked-up sound signal, and generates, for each of the sound pickup unit pairs, a second directional picked-up sound signal by delaying the first picked-up sound signal relative to the second picked-up sound signal and combining the delayed first picked-up sound signal with the second picked-up sound signal, while sequentially changing the sound pickup unit pair;

a comparison signal calculation section that generates, for each of the sound pickup unit pairs, a non-directional level signal indicating a level of a signal obtained by adding up the first directional picked-up sound signal and the second directional picked-up sound signal, and that generates a directional level signal obtained by adding up a first level signal indicating a level of the first directional picked-up sound signal and a second level signal indicating a level of the second directional picked-up sound signal;

a level comparison section that acquires, for each of the sound pickup unit pairs, a level difference between the non-directional level signal and the directional level signal; and a delay operation section that adjusts an amount of the delay in the directivity synthesis processing section so as to reduce the level difference.

2. The sound processing apparatus according to claim 1, wherein the comparison signal calculation section comprises:

a third adder that adds up the first directional picked-up sound signal and the second directional picked-up sound signal;

a first level signal calculation section that extracts level information from an output signal of the third adder and converts the output signal into the non-directional level signal;

a second level signal calculation section that extracts level information from the first directional picked-up sound signal and converts the first directional picked-up sound signal into the first level signal;

a third level signal calculation section that extracts level information from the second directional picked-up sound signal and converts the second directional picked-up sound signal into the second level signal; and a fourth adder that adds up the first level signal and the second level signal and outputs a result of the addition as the directional level signal.

3. The sound processing apparatus according to claim 1, further comprising:

a first band limiting section that limits a band of the first directional picked-up sound signal to be input to the comparison signal calculation section to a frequency band in which no spatial aliasing occurs even when the amount of the delay is varied; and a second band limiting section that limits a band of the second directional picked-up sound signal to be input to the comparison signal calculation section to a frequency band in which no spatial aliasing occurs even when the amount of the delay is varied.

4. The sound processing apparatus according to claim 1, wherein the delay operation section increases the amount of the delay from a sufficiently-small value in a stepwise manner, and fixes the amount of the delay when the level difference reaches a predetermined value.

5. The sound processing apparatus according to claim 4, wherein the delay operation section holds a minimum value of the level difference and monotonically decreases the amount of the delay when the held minimum value is updated within a fixed period of time.

6. The sound processing apparatus according to claim 1, wherein the delay operation section limits a range of the amount of delay to a predetermined range and adjusts the amount of the delay within the predetermined range.

7. The sound processing apparatus according to claim 1, further comprising an uncorrelated component detection section that determines whether or not a large number of uncorrelated components are contained between the first picked-up sound signal and the second picked-up sound signal, wherein the delay operation section does not adjust the amount of the delay based on the first directional picked-up sound signal when the uncorrelated component detection section determines that a large number of uncorrelated components are included.

8. The sound processing apparatus according to claim 7, wherein:

the comparison signal calculation section outputs, as an uncorrelation level signal, a value obtained by subtracting the non-directional level signal from the directional level signal; and the uncorrelated component detection section determines that a large number of uncorrelated components are included, when the uncorrelation level signal exceed a predetermined threshold value.

9. The sound processing apparatus according to claim 1, further comprising a delay calculation section that receives designation of a directivity and that controls the directivity synthesis processing based on an inter-terminal sound distance corresponding to the amount of the delay adjusted by the delay operation section.

10. A sound processing method in a sound processing apparatus that performs, for each of sound pickup unit pairs extracted from three or more sound pickup units, directivity synthesis processing of a first picked-up sound signal output from a first sound pickup unit comprising the sound pickup unit pair and a second picked-up sound signal output from a second sound pickup unit comprising the sound pickup unit pair, the method comprising:

acquiring, for each of the sound pickup unit pairs, a first directional picked-up sound signal and a second directional picked-up sound signal from a directivity synthesis processing section that generates, for each of the sound pickup unit pairs, the first directional picked-up sound signal by delaying the second picked-up sound signal relative to the first picked-up sound signal and combining the first picked-up sound signal with the delayed second picked-up sound signal, and generates, for each of the sound pickup unit pairs, the second directional picked-up sound signal by delaying the first picked-up sound signal relative to the second picked-up sound signal and combining the delayed first picked-up sound signal with the second picked-up sound signal, while sequentially changing the sound pickup unit pair;

generating, for each of the sound pickup unit pairs, a non-directional level signal indicating a level of a signal obtained by adding up the first directional picked-up sound signal and the second directional picked-up sound signal;

generating, for each of the sound pickup unit pairs, a directional level signal obtained by adding up a first level signal indicating a level of the first directional picked-up sound signal and a second level signal indicating a level of the second directional picked-up sound signal;

acquiring, for each of the sound pickup unit pairs, a level difference between the non-directional level signal and the directional level signal; and adjusting, for each of the sound pickup unit pairs, the amount of delay in the directivity synthesis processing section so as to reduce the level difference.

* * * * *